US009454935B2

(12) United States Patent
Park et al.

(10) Patent No.: US 9,454,935 B2
(45) Date of Patent: Sep. 27, 2016

(54) ORGANIC LIGHT EMITTING DIODE DISPLAY DEVICE

(71) Applicant: LG Display Co., Ltd., Seoul (KR)

(72) Inventors: Young-Ju Park, Seoul (KR); Chung-Wan Oh, Gyeonggi-do (KR); Se-Hwan Na, Gyeonggi-do (KR); Ki-Young Sung, Seoul (KR); In-Young Jeon, Busan (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/549,751

(22) Filed: Nov. 21, 2014

(65) Prior Publication Data

US 2015/0138180 A1 May 21, 2015

(30) Foreign Application Priority Data

Nov. 21, 2013 (KR) ..... 10-2013-0142130
Nov. 17, 2014 (KR) ..... 10-2014-0160006

(51) Int. Cl.
*G09G 3/32* (2016.01)

(52) U.S. Cl.
CPC ..... *G09G 3/3266* (2013.01); *G09G 3/3233* (2013.01); *G09G 2300/0404* (2013.01); *G09G 2300/0426* (2013.01); *G09G 2300/0819* (2013.01); *G09G 2300/0842* (2013.01); *G09G 2300/0861* (2013.01); *G09G 2310/0202* (2013.01); *G09G 2310/0262* (2013.01); *G09G 2310/0286* (2013.01); *G09G 2310/08* (2013.01); *G09G 2320/043* (2013.01)

(58) Field of Classification Search
CPC ..... G09G 3/3266; G09G 3/3233; G09G 2300/0404; G09G 2300/0842; G09G 2300/0426; G09G 2300/0819; G09G 2300/0861; G09G 2310/0202; G09G 2310/0262; G09G 2310/0286; G09G 2310/08; G09G 2320/043
See application file for complete search history.

(56) References Cited

U.S. PATENT DOCUMENTS 8,031,141 B2 * 10/2011 Shin ..... G09G 3/325 345/100
2005/0195178 A1 * 9/2005 Jo ..... G09G 3/3233 345/204
2006/0066538 A1 * 3/2006 Kasai ..... G09G 3/325 345/77

(Continued)

FOREIGN PATENT DOCUMENTS

CN 101051440 A 10/2007

OTHER PUBLICATIONS

The First Notification of Office Action dated Aug. 3, 2016 from The State Intellectual Property Office of China in counterpart Chinese application No. 201410677529.7.

*Primary Examiner* — Tom Sheng
(74) *Attorney, Agent, or Firm* — Morgan, Lewis & Bockius LLP

(57) ABSTRACT

An organic light emitting diode display device includes a display panel including a plurality of pixels; a data driver supplying a data signal to the plurality of pixels; a gate driver supplying a plurality of scan signals and a plurality of emission signals to the plurality of pixels, the gate driver including a plurality of stages, at least one of the plurality of stages having a first circuit block generating one of the plurality of scan signals and a second circuit block generating one of the plurality of emission signals using one of the plurality of scan signals; and a timing controller supplying a plurality of control signals to the data driver and the gate driver.

13 Claims, 9 Drawing Sheets

(56) References Cited

U.S. PATENT DOCUMENTS

2006/0071888 A1* 4/2006 Lee ..... G09G 3/3233 345/82
2006/0158394 A1* 7/2006 Choi ..... G09G 3/3266 345/76
2007/0035486 A1* 2/2007 Kasai ..... G09G 3/325 345/76
2007/0040786 A1* 2/2007 Chung ..... G09G 3/3233 345/92
2007/0240024 A1 10/2007 Shin
2007/0262929 A1* 11/2007 Kim ..... G09G 3/006 345/76
2008/0055208 A1* 3/2008 Chung ..... G09G 3/3266 345/76
2008/0246697 A1* 10/2008 Kim ..... G09G 3/006 345/76
2008/0246698 A1* 10/2008 Eom ..... G09G 3/3266 345/76
2009/0009439 A1* 1/2009 Chan ..... G09G 3/3233 345/76
2009/0206770 A1* 8/2009 Hong ..... G09G 3/3233 315/291
2009/0262051 A1* 10/2009 Kim ..... G09G 3/3266 345/80
2011/0041020 A1* 2/2011 Liu ..... G01R 31/318536 714/731
2011/0141091 A1* 6/2011 Eom ..... G09G 3/3233 345/211
2011/0193892 A1* 8/2011 Eom ..... G09G 3/3266 345/690
2012/0062525 A1* 3/2012 Kim ..... G09G 3/3233 345/204
2012/0075259 A1* 3/2012 Chung ..... G09G 3/3266 345/204
2012/0081409 A1* 4/2012 Chung ..... G09G 3/3266 345/690
2013/0043802 A1* 2/2013 Han ..... G09G 3/3233 315/240
2013/0127923 A1* 5/2013 An ..... G09G 5/10 345/690
2014/0071114 A1* 3/2014 Kim ..... G11C 19/28 345/212

* cited by examiner

ORGANIC LIGHT EMITTING DIODE DISPLAY DEVICE

CROSS-REFERENCE TO RELATED APPLICATIONS

The present application claims the benefit of priority of Korean Patent Application No. 10-2013-0142130 filed on Nov. 21, 2013 and No. 10-2014-0160006 filed on Nov. 17, 2014, which are hereby incorporated by reference for all purposes as if fully set forth herein.

BACKGROUND OF THE INVENTION

1. Field of the Invention

The present disclosure relates to an organic light emitting diode display device, and more particularly, to an organic light emitting diode display device including a gate driver.

2. Discussion of the Related Art

As an information society progresses, various demands for a display device displaying an image increase. Recently, various flat panel displays (FPDs) such as a liquid crystal display (LCD) device, a plasma display panel (PDP) device, an organic light emitting diode (OLED) display device and a field emission display (FED) device have been utilized.

Among various FPDs, an OLED display device has advantages in response speed, emission efficiency, brightness and viewing angle due to an emissive device. The OLED display device of a current driving type where brightness of a light emitting diode is adjusted by controlling a current has been generally used.

FIG. 1 is a view showing an organic light emitting diode display device according to the related art, and FIG. 2 is a plan view showing a gate driver of an organic light emitting diode display device according to the related art.

In FIG. 1, an organic light emitting diode (OLED) display device according to the related art includes an external system 10, a timing controller 14, a data driver 16, a gate driver 18 and a display panel 12.

The external system 10 supplies an image signal RGB, a vertical synchronization signal Vsync, a horizontal signal Hsync and a clock signal CLK to the timing controller 14. The timing controller 14 outputs a gate control signal GCS for controlling the gate driver 18 and a data control signal DCS for controlling the data driver 16 using the vertical synchronization signal Vsync, the horizontal signal Hsync and the clock signal CLK. In addition, the timing controller 14 rearranges the image signal RGB according to a resolution of the display panel 12 and outputs the rearranged image signal RGB to the data driver 16.

The data driver 16 converts the image signal RGB to an analog pixel signal (a data signal or a data voltage) corresponding to a gray level of the image signal according to the data control signal DCS from the timing controller 14 and supplies the pixel signal to data lines DL1 to DLm of the display panel 12.

The gate driver 18 sequentially supplies a scan signal to gate lines GL1 to GLn according to the gate control signal GCS from the timing controller 14, and thin film transistors (TFTs) of a corresponding horizontal line in the display panel 12 are turned on. The gate driver 18 includes a scan signal generating unit 18*a* and an emission signal generating unit 18*b*. The scan signal generating unit 18*a* supplies the scan signal for determining an addressing time of the data voltage to the gate lines GL1 to GLn, and the emission signal generating unit 18*b* supplies an emission signal EM for determining an emission time of a pixel P to emission lines EL1 to ELn. The scan signal generating unit 18*a* and the emission signal generating unit 18*b* may be formed in the display panel 12 as a gate in panel (GIP) type.

The display panel 12 includes the gate lines GL1 to GLn, the data lines DL1 to DLm and the pixels P at crossing of the gate lines GL1 to GLn and the data lines DL1 to DLm. Lines for supplying a high level voltage Vdd, a low level voltage Vss and a reference voltage Vref, a switching TFT, a driving TFT turned on by the pixel signal through the switching TFT, an emission TFT driven by the emission lines EL1 to ELn and a light emitting diode (LED) are formed in each pixel P.

In the OLED display device according to the related art, the gate driver 18 controls the emission of each pixel P by the scan signal generating unit 18*a* and the emission signal generating unit 18*b*. A variation in threshold voltage due to deterioration of the driving TFT may be compensated by making timings of the scan signal and the emission signal different.

For example, the scan signal has a turn-on level and the emission signal has a turn-off level during a period for addressing the data voltage is addressed, the scan signal has a turn-off level and the emission signal has a turn-on level during a period for emitting the pixel P.

Specifically, for sequentially outputting signals by a cascade connection, the emission signal generating unit 18*b* includes a shift register SR and an inverter INV generating an emission control pulse by inverting the signal from the shift register SR. Similarly, for sequentially outputting signals by a cascade connection, the scan signal generating unit 18*a* includes a shift register SRG.

However, since the gate driver 18 includes the scan signal generating unit 18*a* and the emission signal generating unit 18*b* for generating two signals, control signals for controlling the scan signal generating unit 18*a* and the emission signal generating unit 18*b* increase and lines for transmitting the control signals increase.

Further, as shown in FIG. 2, the gate driver 18 of a GIP type is formed in a non-display area of the display panel 12, and an area W for the gate driver 18 which is a sum of a first area W1 for the scan signal generating unit 18*a* and a second area W2 for the emission signal generating unit 18*b* increases. Specifically, since the second area W2 for the emission signal generating unit 18*b* is a sum of an area W2*a* for the shift register SR and an area W2*b* for the inverter INV, the area W for the gate driver 18 further increases. As a result, a bezel area, which is a non-display area, of the OLED display device increases due to the gate driver 18 of a GIP type and appearance of the OLED display device is deteriorated.

SUMMARY OF THE INVENTION

Accordingly, the present invention is directed to an organic light emitting diode display device that substantially obviate one or more of the problems due to limitations and disadvantages of the related art.

An object of the present invention is to provide an organic light emitting diode display device where an area for a gate driver is reduced.

Additional features and advantages of the invention will be set forth in the description which follows, and in part will be apparent from the description, or may be learned by practice of the invention. The objectives and other advantages of the invention may be realized and attained by the structure particularly pointed out in the written description and claims hereof as well as the appended drawings.

To achieve these and other advantages and in accordance with the purposed of the present invention, as embodied and broadly described, an organic light emitting diode display device includes a display panel including a plurality of pixels; a data driver supplying a data signal to the plurality of pixels; a gate driver supplying a plurality of scan signals and a plurality of emission signals to the plurality of pixels, the gate driver including a plurality of stages, at least one of the plurality of stages having a first circuit block generating one of the plurality of scan signals and a second circuit block generating one of the plurality of emission signals using one of the plurality of scan signals; and a timing controller supplying a plurality of control signals to the data driver and the gate driver.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Reference will now be made in detail to the preferred embodiments, examples of which are illustrated in the accompanying drawings.

Figure 3:
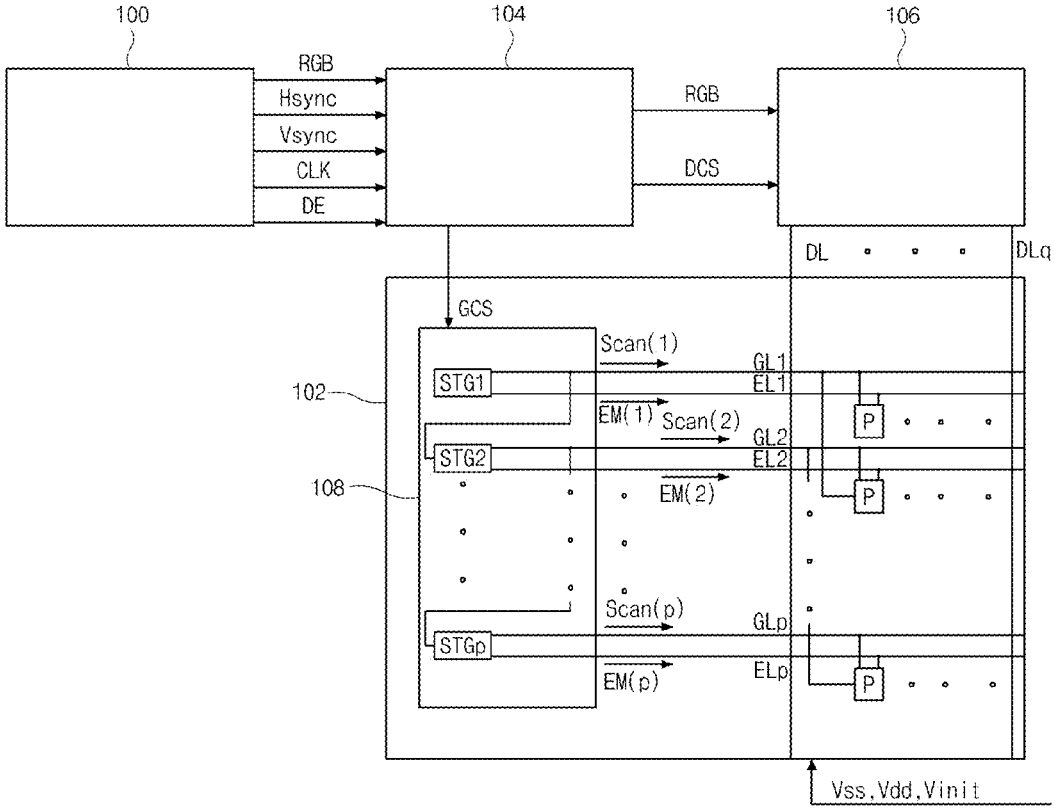
FIG. 3 is a view showing an organic light emitting diode display device according to a first embodiment of the present invention.

FIG. 3 is a view showing an organic light emitting diode display device according to a first embodiment of the present invention.

In FIG. 3, an organic light emitting diode (OLED) display device according to a first embodiment of the present invention includes an external system 100, a timing controller 104, a data driver 106, a gate driver 108 and a display panel 102.

The display panel 102 includes a plurality of gate lines GL1 to GLp, a plurality of emission lines EL1 to ELp alternating with the plurality of gate lines GL1 to GLp, a plurality of data lines DL1 to DLq crossing he plurality of gate lines GL1 to GLp and the plurality of emission lines EL1 to ELp and a plurality of pixels P at crossing of the plurality of gate lines GL1 to GLp, the plurality of emission lines EL1 to ELp and the plurality of data lines DL1 to DLq.

For example, a high level voltage Vdd (of FIG. 4), a low level voltage Vss (of FIG. 4) and an initialization voltage Vinit (of FIG. 4) may be supplied to each pixel P through a plurality of conductive lines. In addition, each pixel may be connected to one data line, two adjacent gate lines and one emission line.

The external system 100 supplies an image signal RGB, a vertical synchronization signal Vsync, a horizontal signal Hsync, a clock signal CLK and a data enable signal DE to the timing controller 104.

The timing controller 104 outputs a gate control signal GCS for controlling the gate driver 108 and a data control signal DCS for controlling the data driver 106 using the vertical synchronization signal Vsync, the horizontal signal Hsync, the clock signal CLK and the data enable signal DE. In addition, the timing controller 104 rearranges the image signal RGB according to a resolution of the display panel 102 and outputs the rearranged image signal RGB to the data driver 106.

The data driver 106 converts the digital image signal RGB to a plurality of analog pixel signals (data signals or data voltages) corresponding to a gray level of the image signal according to the data control signal DCS from the timing controller 104 and supplies the data signals to the plurality of data lines DL1 to DLq of the display panel 102.

The gate driver 108 sequentially supplies a plurality of scan signals Scan(1) to Scan(p) to the plurality of gate lines GL1 to GLp and a plurality of emission signals EM(1) to EM(p) to the plurality of emission lines EL1 to ELp according to the gate control signal GCS from the timing controller 104. Thin film transistors (TFTs) of a corresponding horizontal line of the display panel 102 are turned on according to the plurality of scan signals Scan(1) to Scan(p) and the plurality of emission signals EM(1) to EM(p).

The gate driver 108 includes a plurality of stages STG1 to STGp for generating the plurality of scan signals Scan(1) to Scan(p) and the plurality of emission signals EM(1) to EM(p). The plurality of stages STG1 to STGp connected in cascade may be formed in the display panel 102 as a gate in panel (GIP) type.

Figure 4:
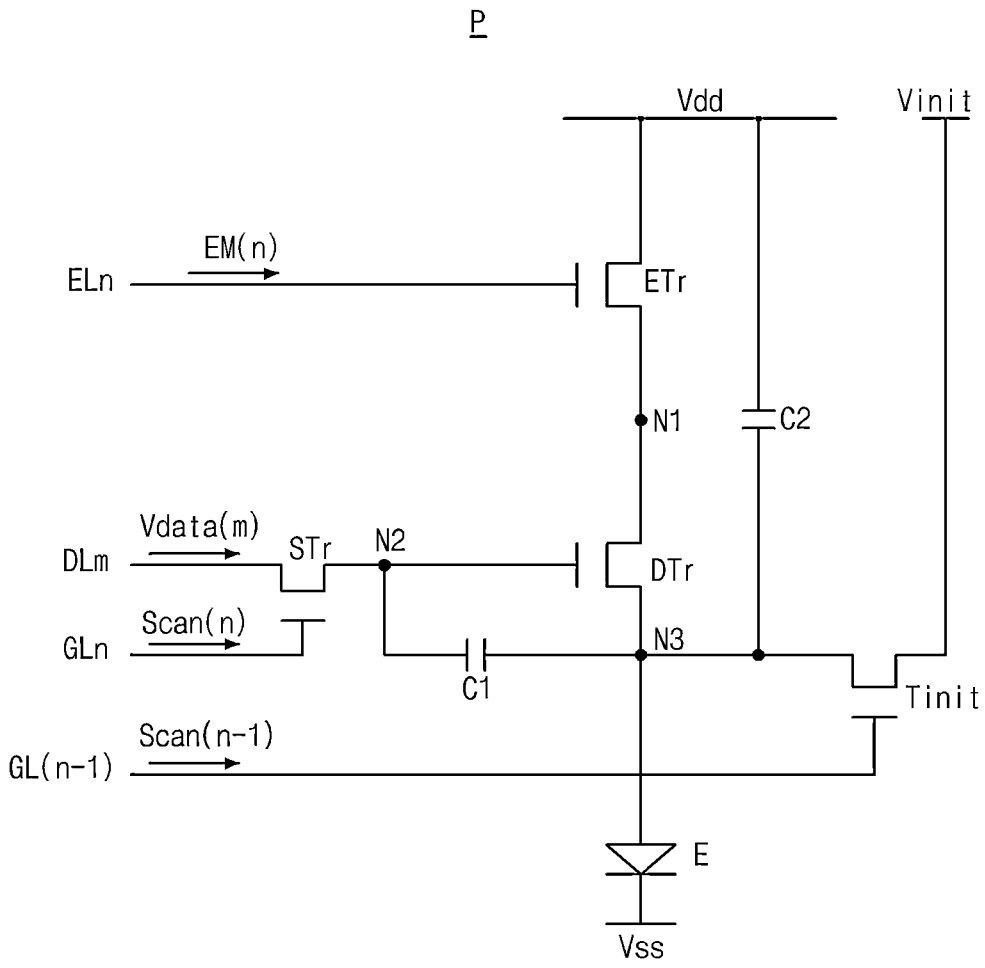
FIG. 4 is a view showing a pixel of an organic light emitting diode display device according to a first embodiment of the present invention.

FIG. 4 is a view showing a pixel of an organic light emitting diode display device according to a first embodiment of the present invention.

In FIG. 4, a pixel P includes a light emitting diode E, an emission TFT ETr, a switching TFT STr, a driving TFT DTr, an initialization TFT Tinit and first and second pixel capacitors Cp1 and Cp2. The pixel P has a 4T2C structure where four transistors and two capacitors are formed in the pixel P. Although the emission TFT ETr, the switching TFT STr, the driving TFT DTr, the initialization TFT Tinit have a negative (N) type in FIG. 4, the emission TFT ETr, the switching TFT STr, the driving TFT DTr, the initialization TFT Tinit may have a positive (P) type in another embodiment.

The light emitting diode E emits a light by a driving current flowing between the high level voltage Vdd and the low level voltage Vss. For example, a cathode of the light emitting diode E may be connected to an input terminal of the low level voltage Vss and an anode of the light emitting diode E may be connected to a source of the driving TFT DTr.

The emission TFT ETr is connected between an input terminal of the high level voltage Vdd and the driving TFT DTr to control transmission of the high level voltage Vdd according to the nth emission signal EM(n). For example, a gate of the emission TFT DTr may be connected to the nth emission line ELn, a drain of the emission TFT DTr may be connected to an input terminal of the high level voltage Vdd, and a source of the emission TFT DTr may be connected to a drain of the driving TFT DTr. A connection point between the source of the emission TFT ETr and the drain of the driving TFT DTr may be defined as a first node N1.

The switching TFT STr is connected between the mth data line DLm and the driving TFT DTr to control transmission of the mth data signal Vdata(m) according to the nth scan signal Scan(n). For example, a gate of the switching TFT STr may be connected to the nth gate line GLn, a drain of the switching TFT STr may be connected to the mth data line DLm, and a source of the switching TFT STr may be connected to a gate of the driving TFT DTr. A connection point between the source of the switching TFT STr and the gate of the driving TFT DTr may be defined as a second node N2.

The driving TFT DTr is connected between the first node N1 and the light emitting diode E to control a driving current supplied to the anode of the light emitting diode E according to a voltage of the second node N2. For example, the gate of the driving TFT DTr may be connected to the second node N2, the drain of the driving TFT DTr may be connected to the first node N1, and the source of the driving TFT DTr may be connected to the anode of the light emitting diode E. A connection point between the source of the driving TFT DTr and the anode of the light emitting diode E may be defined as a third node N3.

The initialization TFT Tinit is connected between an input terminal of the initialization voltage Vinit and the third node N3 to control transmission of the initialization voltage Vinit according to the (n−1)th scan signal Scan(n−1). A voltage of the source of the driving TFT DTr may be initialized as the initialization voltage Vinit by the initialization TFT Tinit. For example, a gate of the initialization TFT Tinit may be connected to the (n−1)th gate line GL(n−1), a drain of the initialization TFT Tinit may be connected to the input terminal of the initialization voltage Vinit, and a source of the initialization TFT Tinit may be connected to the third node N3.

The first pixel capacitor Cp1 is connected between the second node N2 and the third node N3, and the second pixel capacitor Cp2 is connected between the input terminal of the high level voltage Vdd and the third node N3. The first pixel capacitor Cp1 may store a threshold voltage of the driving TFT DTr according to nth emission signal EM(n) and may maintain the voltage of the gate of the driving TFT DTr according to the nth scan signal Scan(n) during one frame. The second pixel capacitor Cp2 may stabilize the voltage of the gate of the driving TFT DTr and improve an efficiency of the mth data signal Vdata(m).

Figure 5:
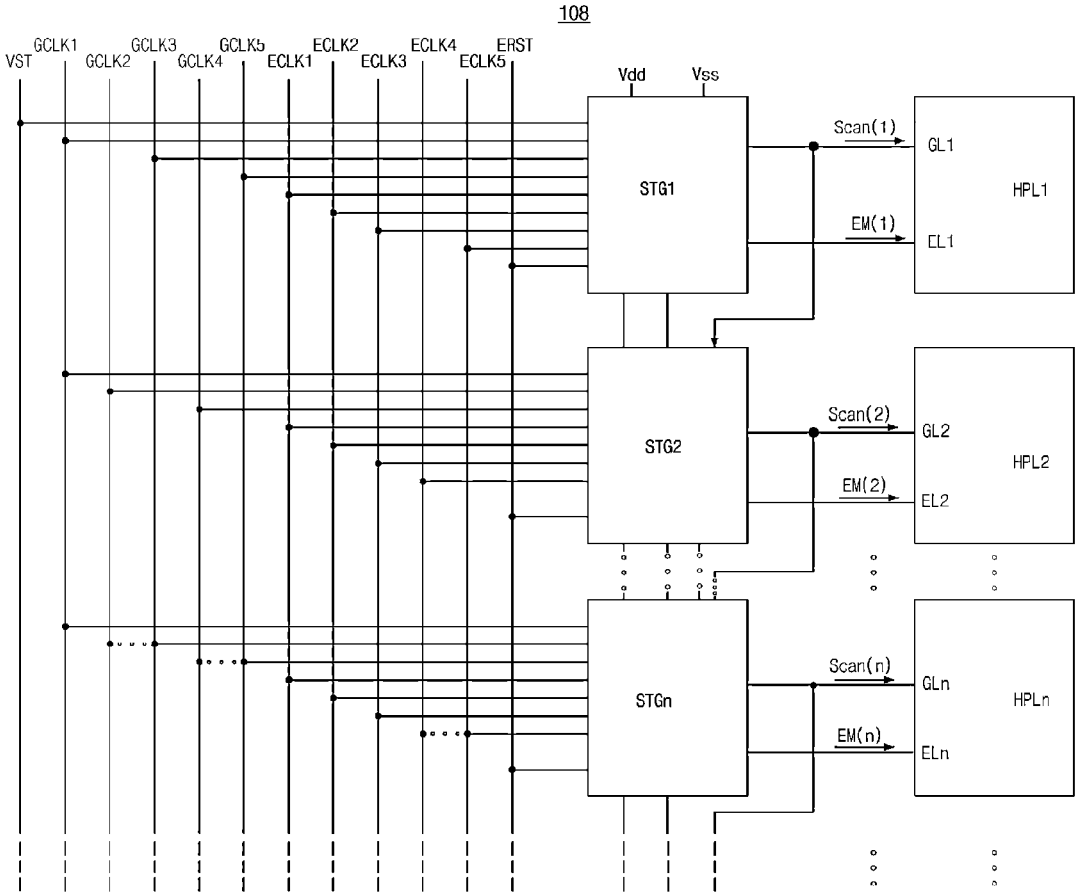
FIG. 5 is a view showing a gate driver of an organic light emitting diode display device according to a first embodiment of the present invention.

FIG. 5 is a view showing a gate driver of an organic light emitting diode display device according to a first embodiment of the present invention.

In FIG. 5, the gate driver 108 includes the plurality of stages STG1 to STGp sequentially outputting the plurality of scan signals Scan(1) to Scan(p) and the plurality of emission signals EM(1) to EM(p) using the high level voltage Vdd, the low level voltage Vss, a start voltage VST, first to fifth gate clocks GCLK1 to GCLK5 of 5-phase pulse, first to fifth emission clocks ECLK1 to ECLK5 of 5-phase pulse and emission reset voltage ERST. In addition, each stage may include a first circuit block BL1 (of FIGS. 6A and 6B) generating the plurality of scan signals Scan(1) to Scan(p) and a second circuit block BL2 (of FIGS. 6A and 6B0 generating the plurality of emission signals EM(1) to EM(p).

For example, the first stage STG1 may output the first scan signal Scan(1) and the first emission signal EM(1) using the high level voltage Vdd, the low level voltage Vss, the start voltage VST, the first, third and fifth gate clocks GCLK1, GCLK3 and GCLK5, the first, second, third and fifth emission clocks ECLK1, ECLK2, ECLK3 and ECLK5 and the emission reset voltage ERST. The first scan signal Scan(1) and the first emission signal EM(1) may be supplied to the first gate line GL1 and the first emission line ELL respectively, corresponding to a first horizontal pixel line HPL1.

In addition, the second stage STG2 may output the second scan signal Scan(2) and the second emission signal EM(2) using the high level voltage Vdd, the low level voltage Vss, the first scan signal Scan(1), the first, second and fourth gate clocks GCLK1, GCLK2 and GCLK4, the first, second, third and fourth emission clocks ECLK1, ECLK2, ECLK3 and ECLK4 and the emission reset voltage ERST. The second scan signal Scan(2) and the second emission signal EM(2) may be supplied to the second gate line GL2 and the second emission line EL2, respectively, corresponding to a second horizontal pixel line HPL2.

Similarly, the nth stage STGn may output the nth scan signal Scan(n) and the nth emission signal EM(n) using the high level voltage Vdd, the low level voltage Vss, the (n−1)th scan signal Scan(n−1), the first gate clock GCLK1, one of a pair of third and fifth gate clocks GCLK3 and GCLK5 and a pair of the second and fourth gate clocks GCLK2 and GCLK4, the first, second and third emission clocks ECLK1, ECLK2 and ECLK3, one of fourth and fifth emission clocks ECLK4 and ECLK5 and the emission reset voltage ERST. The nth scan signal Scan(n) and the nth emission signal EM(n) may be supplied to the nth gate line GLn and the nth emission line ELn, respectively, corresponding to an nth horizontal pixel line HPLn.

As a result, the plurality of stages STG1 to STGp has a cascade connection such that the scan signal outputted from the previous stage is inputted to the present stage as the start voltage VST.

Figure 6A:
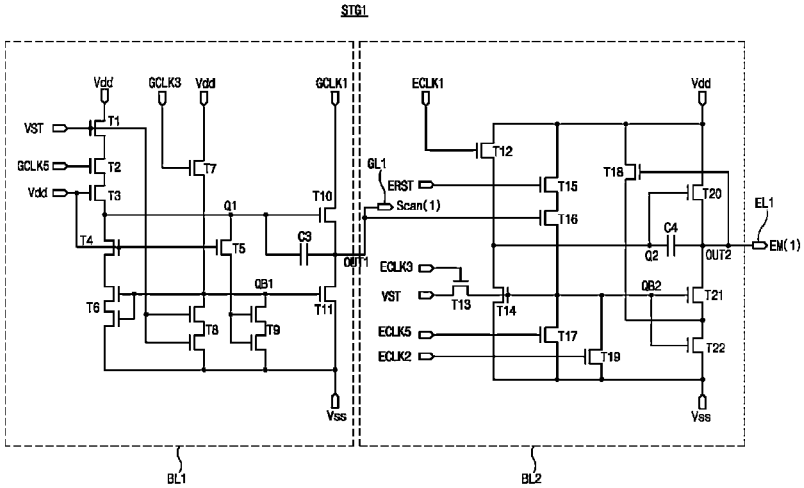
FIGS. 6A and 6B are views showing first and second stages, respectively, of a light emitting diode display device according to a first embodiment of the present invention.
Figure 6B:
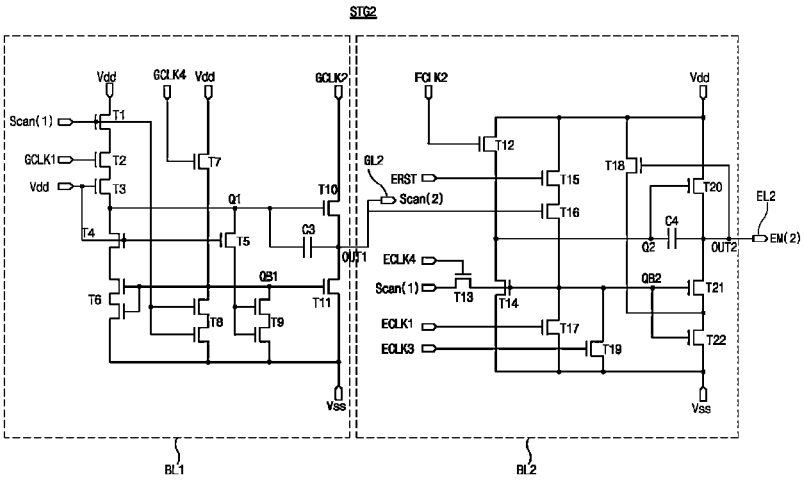

FIGS. 6A and 6B are views showing first and second stages, respectively, of a light emitting diode display device according to a first embodiment of the present invention.

In FIG. 6A, the first circuit block BL1 of the first stage STG1 generates the first scan signal Scan(1) using the high level voltage Vdd, the low level voltage Vss, the start voltage VST and the first, third and fifth gate clocks GCLK1, GCLK3 and GCLK5. The second circuit block BL2 of the first stage STG1 generates the first emission signal EM(1) using the high level voltage Vdd, the low level voltage Vss, the first scan signal Scan(1) outputted from the first circuit block BL1, the first, second, third and fifth emission clocks ECLK1, ECLK2, ECLK3 and ECLK5 and the emission reset voltage ERST.

As a result, the gate driver 108 may include a single stage generating the scan signal and the emission signal in the first embodiment of the present invention, while the gate driver includes the scan signal generating unit generating the scan signal and the emission signal generating unit generating the emission signal in the related art.

The first circuit block BL1 of the first stage STG1 may include first to eleventh TFTs T1 to T11 and a first driving capacitor Cd1. A gate of the first TFT T1 may be connected to an input terminal of the start voltage VST, a drain of the first TFT T1 may be connected to an input terminal of the high level voltage Vdd and a source of the first TFT T1 may be connected to a drain of the second TFT T2. A gate of the second TFT T2 may be connected to an input terminal of the fifth gate clock GCLK5, a drain of the second TFT T2 may be connected to the source of the first TFT T1 and a source of the second TFT T2 may be connected to a drain of the third TFT T3.

A gate of the third TFT T3 may be connected to an input terminal of the high level voltage Vdd, a drain of the third TFT T3 may be connected to the source of second TFT T2, and a source of the third TFT T3 may be connected to a first Q node Q1. A gate of the fourth TFT T4 may be connected to an input terminal of the high level voltage Vdd, a drain of the fourth TFT T4 may be connected to the first Q node Q1, and a source of the fourth TFT T4 may be connected to a drain of the sixth TFT T6. A gate of the fifth TFT T5 may be connected to an input terminal of the high level voltage Vdd, a drain of the fifth TFT T5 may be connected to the first Q node Q1, and a source of the fifth TFT T5 may be connected to a gate of the eleventh TFT T11.

A gate of the sixth TFT T6 may be connected to a first QB node QB1, a drain of the sixth TFT T6 may be connected to a source of the fourth TFT T4, and a source of the sixth TFT T6 may be connected to an input terminal of the low level voltage Vss. Although the sixth TFT T6 has a dual gate type for improving an off-current property in FIG. 6A, the sixth TFT T6 may have a single gate type in another embodiment having a relatively small off-current. A gate of the seventh TFT T7 may be connected to an input terminal of the third gate clock GCLK3, a drain of the seventh TFT T7 may be connected to an input terminal of the high level voltage Vdd, and a source of the seventh TFT T7 may be connected to the first QB node QB1.

A gate of the eighth TFT T8 may be connected to an input terminal of the start voltage VST, a drain of the eighth TFT T8 may be connected to the first QB node QB1, and a source of the eighth TFT T8 may be connected to an input terminal of the low level voltage Vss. A gate of the ninth TFT T9 may be connected to a source of the fifth TFT T5, a drain of the ninth TFT T9 may be connected to the first QB node QB1, and a source of the ninth TFT T9 may be connected to an input terminal of the low level voltage Vss. Although each of the eighth and ninth TFTs T8 and T9 has a dual gate type for improving an off-current property in FIG. 6A, each of the eighth and ninth TFTs T8 and T9 may have a single gate type in another embodiment having a relatively small off-current.

A gate of the tenth TFT T10 may be connected to the first Q node Q1, a drain of the tenth TFT T10 may be connected to an input terminal of the first gate clock GCLK1, and a source of the tenth TFT T10 may be connected to a drain of the eleventh TFT T11. The first driving capacitor Cd1 is connected between the gate and the source of the tenth TFT T10. A gate of the eleventh TFT T11 may be connected to the first QB node QB1, a drain of the eleventh TFT T11 may be connected to a source of the tenth TFT T10, and a source of the eleventh TFT T11 may be connected to an input terminal of the low level voltage Vss.

A first output node OUT1 between the source of the tenth TFT T10 and the drain of the eleventh TFT T11 may be connected to the first gate line GL1, the second circuit block BL2 of the first stage STG1 and the first circuit block BL1 of the second stage STG2, and the first scan signal Scan(1) outputted from the first output node OUT1 may be supplied to the first gate line GL1, the second circuit block BL2 of the first stage STG1 and the first circuit block BL1 of the second stage STG2.

The second circuit block BL2 of the first stage STG1 may include twelfth to twenty-second TFTs T12 to T22 and a second driving capacitor Cd2. A gate of the twelfth TFT T12 may be connected to an input terminal of the first emission clock ECLK1, a drain of the twelfth TFT T12 may be connected to an input terminal of the high level voltage Vdd and a source of the twelfth TFT T12 may be connected to a second Q node Q2. A gate of the thirteenth TFT T13 may be connected to an input terminal of the third emission clock ECLK3, a drain of the thirteenth TFT T13 may be connected to an input terminal of the start voltage VST and a source of the thirteenth TFT T13 may be connected to a second QB node QB2. A gate of the fourteenth TFT T14 may be connected to the second QB node QB2, a drain of the fourteenth TFT T14 may be connected to the second Q node Q2, and a source of the fourteenth TFT T14 may be connected to an input terminal of the low level voltage Vss.

A gate of the fifteenth TFT T15 may be connected to an input terminal of the emission reset voltage ERST, a drain of the fifteenth TFT T15 may be connected to an input terminal of the high level voltage Vdd, and a source of the fifteenth TFT T15 may be connected to a drain of the sixteenth TFT T16. A gate of the sixteenth TFT T16 may be connected to the first output node OUT1 of the first circuit block BL1 of the first stage STG1, a drain of the sixteenth TFT T16 may be connected to a source of the fifteenth TFT T15, and a source of the sixteenth TFT T16 may be connected to the second QB node QB2.

A gate of the seventeenth TFT T17 may be connected to an input terminal of the fifth emission clock ECLK5, a drain of the seventeenth TFT T17 may be connected to the second QB node QB2, and a source of the seventeenth TFT T17 may be connected to an input terminal of the low level voltage Vss. A gate of the eighteenth TFT T18 may be connected to a second output node OUT2, a drain of the eighteenth TFT T18 may be connected to an input terminal of the high level voltage Vdd, and a source of the eighteenth TFT T18 may be connected to a source of the twenty-first TFT T21. A gate of the nineteenth TFT T19 may be connected to an input terminal of the second emission clock ECLK2, a drain of the nineteenth TFT T19 may be connected to the second QB node QB2, and a source of the nineteenth TFT T19 may be connected to an input terminal of the low level voltage Vss.

A gate of the twentieth TFT T20 may be connected to the second Q node Q2, a drain of the twentieth TFT T20 may be connected to an input terminal of the high level voltage Vdd, and a source of the twentieth TFT T20 may be connected to a drain of the twenty-first TFT T21. The second driving capacitor Cd2 is connected between the gate and the source of the twentieth TFT T20. A gate of the twenty-first TFT T21 may be connected to the second QB node QB2, a drain of the twenty-first TFT T21 may be connected to a source of the twentieth TFT T20, and a source of the twenty-first TFT T21 may be connected to a drain of the twenty-second TFT T22.

A gate of the twenty-second TFT T22 may be connected to the second QB node QB2, a drain of the twenty-second TFT T22 may be connected to a source of the twenty-first TFT T21, and a source of the twenty-second TFT T22 may be connected to an input terminal of the low level voltage Vss.

The second output node OUT2 between the source of the twentieth TFT T20 and the drain of the twenty-first TFT T21 may be connected to the first emission line EL1, and the first emission signal EM(1) outputted from the second output node OUT2 may be supplied to the first emission line EL1.

In FIG. 6B, the first and second circuit blocks BL1 and BL2 of the second stage STG2 use the nth scan signal Scan(n) instead of the start voltage VST. The first circuit block BL1 of the second stage STG2 has a similar structure to the first circuit block BL1 of the first stage STG1, and the second circuit block BL2 of the second stage STG2 has a similar structure to the second circuit block BL2 of the first stage STG1. Illustration for the same structure is omitted.

In the first circuit block BL1 of the second stage STG2, a gate of the first TFT T1 may be connected to the first output node OUT1 of the first circuit block BL1 of the first stage STG1 instead of an input terminal of the start voltage VST. A gate of the second TFT T2 may be connected to an input terminal of the first gate clock GCLK1 instead of an input terminal of the fifth gate clock GCLK5. A gate of the seventh TFT T7 may be connected to an input terminal of the fourth gate clock GCLK4 instead of an input terminal of the third gate clock GCLK3. A drain of the tenth TFT T10 may be connected to an input terminal of the second gate clock GCLK2 instead of an input terminal of the first gate clock GCLK1.

In addition, the first output node OUT1 of the second stage STG2 may be connected to the second gate line GL2, the second circuit block BL2 of the second stage STG2 and the first circuit block BL1 of third stage STG3, and the second scan signal Scan(2) outputted from the first output node OUT1 of the second stage STG2 may be supplied to the second gate line GL2, the second circuit block BL2 of the second stage STG2 and the first circuit block BL1 of the third stage STG3.

In the second circuit block BL2 of the second stage STG2, a gate of the twelfth TFT T12 may be connected to an input terminal of the second emission clock ECLK2 instead of an input terminal of the first emission clock ECLK1. A gate of the thirteenth TFT T13 may be connected to an input terminal of the fourth emission clock ECLK4 instead of an input terminal of the third emission clock ECLK3, and a drain of the thirteenth TFT T13 may be connected to the first output node OUT1 instead of an input terminal of the start voltage VST. A gate of the seventeenth TFT T17 may be connected to an input terminal of the first emission clock ECLK1 instead of an input terminal of the fifth emission clock ECLK5. A gate of the nineteenth TFT T19 may be connected to an input terminal of the third emission clock ECLK3 instead of an input terminal of the second emission clock ECLK2.

In addition, the second output node OUT2 may be connected to the second emission line EL2, and the second emission signal EM(2) outputted from the second output node OUT2 may be supplied to the second emission line EM2.

Although not shown, the other stages STG3 to STGp may have a structure similar to the second stage STG2, and the plurality of stages STG1 to STGp may be connected in cascade. For example, the nth stage STGn may output the nth scan signal Scan(n) and the nth emission signal EM(n) using the high level voltage Vdd, the low level voltage Vss, the (n−1)th scan signal Scan(n−1), the first, third and fifth gate clocks GCLK1, GCLK3 and GCLK5, the first, second, third and fifth emission clocks ECLK1, ECLK2, ECLK3 and ECLK5 and the emission reset voltage ERST. The nth scan signal Scan(n) and the nth emission signal EM(n) may be supplied to the nth gate line GLn and the nth emission line ELn, respectively, corresponding to an nth horizontal pixel line HPLn. In addition, the (n+1)th stage STG(n+1) may output the (n+1)th scan signal Scan(n+1) and the (n+1)th emission signal EM(n+1) using the high level voltage Vdd, the low level voltage Vss, the nth scan signal Scan(n), the first, second and fourth gate clocks GCLK1, GCLK2 and GCLK4, the first, second, third and fourth emission clocks ECLK1, ECLK2, ECLK3 and ECLK4 and the emission reset voltage ERST. The (n+1)th scan signal Scan(n+1) and the (n+1)th emission signal EM(n+1) may be supplied to the (n+1)th gate line GL(n+1) and the (n+1)th emission line EL(n+1), respectively, corresponding to an (n+1)th horizontal pixel line HPL(n+1).

Although the first to twenty-second TFTs T1 to T22 have a negative (N) type in FIGS. 6A and 6B, at least one of the first to twenty-second TFTs T1 to T22 may have a positive (P) type in another embodiment.

Operation of the gate driver of the OLED device according to a first embodiment of the present invention will be illustrated hereinafter.

Figure 7:
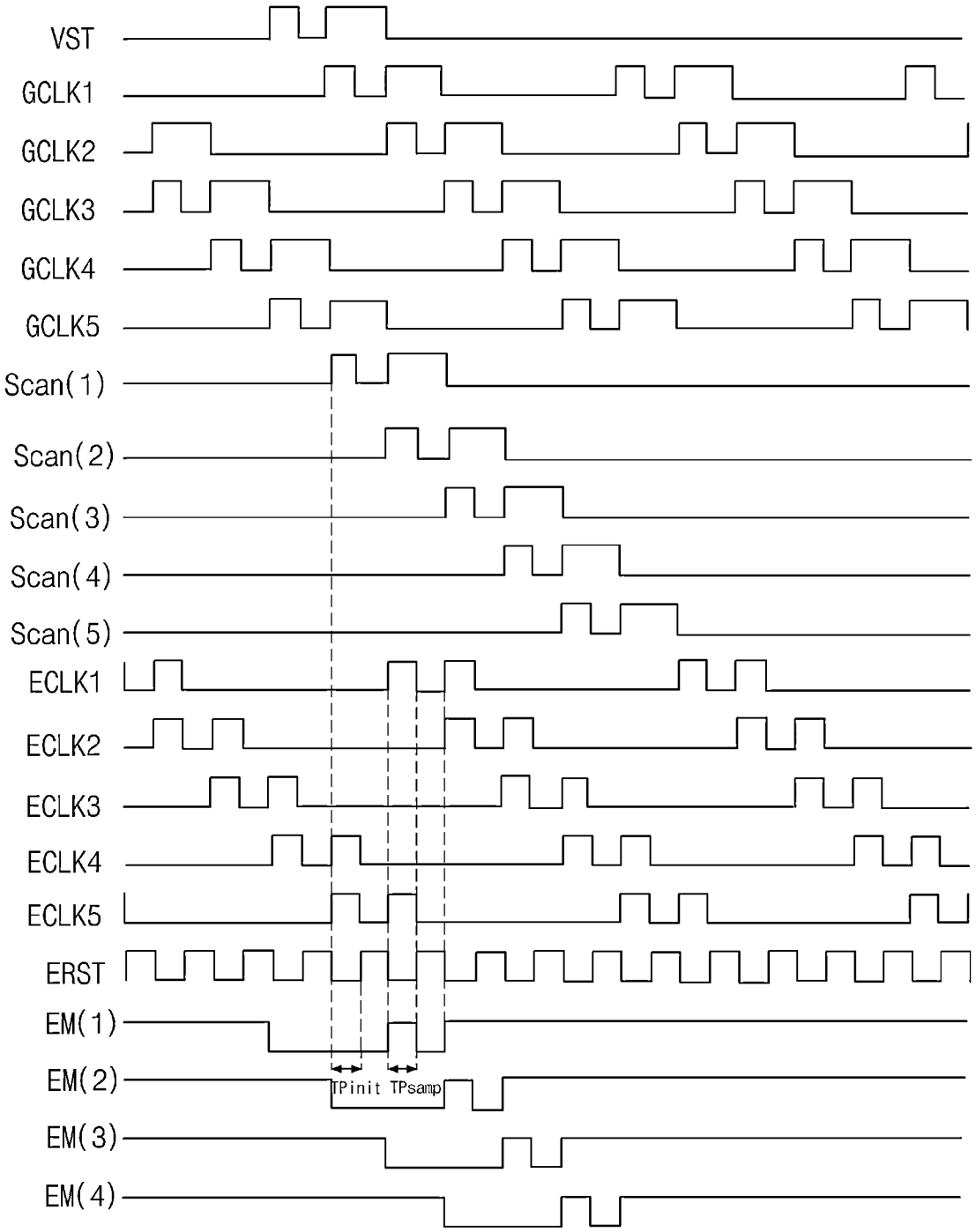
FIG. 7 is a timing chart showing signals used in a light emitting diode display device according to a first embodiment of the present invention.

FIG. 7 is a timing chart showing signals used in a light emitting diode display device according to a first embodiment of the present invention.

In FIGS. 6A, 6B and 7, when high levels of the start voltage VST and the fifth gate clock GCLK5 are inputted to the first circuit block BL1 of the first stage STG1, the first and second TFTs T1 and T2 of the first circuit block BL1 of the first stage STG1 are turned on and the first Q node Q1 of the first circuit block BL1 of the first stage STG1 has a logic high state corresponding to the high level voltage Vdd. As a result, the tenth TFT T10 whose gate is connected to the first Q node Q1 of the first circuit block BL1 of the first stage STG1 has a ready state. Next, when a high level of the first gate clock GCLK1 is inputted to the first circuit block BL1 of the first stage STG1, the tenth TFT T10 of the first circuit block BL1 of the first stage STG1 is turned on and the first scan signal Scan(1) is outputted from the first output node OUT1 of the first circuit block BL1 of the first stage STG1. The first scan signal Scan(1) outputted from the first output node OUT1 of the first circuit block BL1 of the first stage STG1 may be inputted to the first gate line GL1, the sixteenth TFT T16 of the second circuit block BL2 of the first stage STG1 and the first circuit block BL1 of the second stage STG2.

When the first gate clock GCLK1 is inputted to the first circuit block BL1 of the second stage STG2, the first and second TFTs T1 and T2 of the first circuit block BL1 of the second stage STG2 are turned on and the first Q node Q1 of the first circuit block BL1 of the second stage STG2 has a logic high state corresponding to the high level voltage Vdd. As a result, the tenth TFT T10 whose gate is connected to the first Q node Q1 of the first circuit block BL1 of the second stage STG2 has a ready state. Next, when a high level of the second gate clock GCLK2 is inputted to the first circuit block BL1 of the second stage STG2, the tenth TFT T10 of the first circuit block BL1 of the second stage STG2 is turned on and the second scan signal Scan(2) is outputted from the first output node OUT1 of the first circuit block BL1 of the second stage STG2. The second scan signal Scan(2) outputted from the first output node OUT1 of the first circuit block BL1 of the second stage STG2 may be inputted to the second gate line GL2, the sixteenth TFT T16 of the second circuit block BL2 of the second stage STG2 and the first circuit block BL1 of the third stage STG3.

The first circuit block BL1 of the second stage STG2 generates the second scan signal Scan(2) using the first scan signal Scan(1) outputted from the first circuit block BL1 of the first stage STG1 instead of the start voltage VST. As a result, the first circuit blocks (odd circuit blocks) of the plurality of stages STG1 to STGp are connected in cascade such that the first circuit block of the present stage generates the present scan signal using the previous scan signal outputted from the first circuit block of the previous stage.

In addition, when high levels of the start voltage VST and the third emission clock ECLK3 are inputted to the second circuit block BL2 of the first stage STG1, the thirteenth TFT T13 of the second circuit block BL2 of the first stage STG1 is turned on and the second QB node QB2 of the second circuit block BL2 of the first stage STG1 has a logic high state. As a result, the twenty-first and twenty-second TFTs T21 and T22 of the second circuit block BL2 of the first stage STG1 are turned on and the first emission signal EM(1) having a logic low state corresponding to the low level voltage Vss is outputted from the second output node OUT2 of the second circuit block BL2 of the first stage STG1. Next, when a high level of the fifth emission clock ECLK5 is inputted to the second circuit block BL2 of the first stage STG1, the seventeenth TFT T17 of the second circuit block BL2 of the first stage STG1 is turned on and the second QB node QB2 of the second circuit block BL2 of the first stage STG1 is changed from a logic high state to a logic low sate corresponding to the low level voltage Vss. As a result, the twenty-first and twenty-second TFTs T21 and T22 of the second circuit block BL2 of the first stage STG1 are turned off and the first emission signal EM(1) is held to have a logic low state corresponding to the low level voltage Vss.

Next, when a high level of the first emission clock ECLK1 is inputted to the second circuit block BL2 of the first stage STG1, the twelfth TFT T12 is turned on and the second Q node Q2 of the second circuit block BL2 of the first stage STG1 has a logic high state corresponding to the high level voltage Vdd. As a result, the twentieth TFT T20 of the second circuit block BL2 of the first stage STG1 is turned on and the first emission signal EM(1) has a logic high state corresponding to the high level voltage Vdd. That is, the first emission signal EM(1) is changed from a logic low state to a logic high state.

Next, when high levels of the emission reset voltage ERST and the first scan signal Scan(1) are inputted to the second circuit block BL2 of the first stage STG1, the fifteenth and sixteenth TFTs T15 and T16 of the second circuit block BL2 of the first stage STG1 are turned on and the second QB node QB2 of the second circuit block BL2 of the first stage STG1 has a logic high state corresponding to the high level voltage Vdd. As a result, the twenty-first and twenty-second TFTs T21 and T22 of the second circuit block BL2 of the first stage STG1 are turned on and the first emission signal EM(1) has a logic low state corresponding to the low level voltage Vss. That is, the first emission signal EM(1) is changed from a logic high stat to a logic low state.

Next, when a high level of the first emission clock ECLK1 is inputted to the second circuit block BL2 of the first stage STG1, the twelfth TFT T12 is turned on and the second Q node Q2 of the second circuit block BL2 of the first stage STG1 has a logic high state corresponding to the high level voltage Vdd. As a result, the twentieth TFT T20 of the second circuit block BL2 of the first stage STG1 is turned on and the first emission signal EM(1) has a logic high state corresponding to the high level voltage Vdd. That is, the first emission signal EM(1) is changed from a logic low state to a logic high state.

Further, when high levels of the first scan signal Scan(1) and the fourth emission clock ECLK4 are inputted to the second circuit block BL2 of the second stage STG2, the thirteenth TFT T13 of the second circuit block BL2 of the second stage STG2 is turned on and the second QB node QB2 of the second circuit block BL2 of the second stage STG2 has a logic high state. As a result, the twenty-first and twenty-second TFTs T21 and T22 of the second circuit block BL2 of the second stage STG2 are turned on and the second emission signal EM(2) having a logic low state corresponding to the low level voltage Vss is outputted from the second output node OUT2 of the second circuit block BL2 of the second stage STG2. Next, when a high level of the first emission clock ECLK1 is inputted to the second circuit block BL2 of the second stage STG2, the seventeenth TFT T17 of the second circuit block BL2 of the second stage STG2 is turned on and the second QB node QB2 of the second circuit block BL2 of the second stage STG2 is changed from a logic high state to a logic low state corresponding to the low level voltage Vss. As a result, the twenty-first and twenty-second TFTs T21 and T22 of the second circuit block BL2 of the second stage STG2 are turned off and the second emission signal EM(2) is held to have a logic low state corresponding to the low level voltage Vss.

Next, when a high level of the second emission clock ECLK2 is inputted to the second circuit block BL2 of the second stage STG2, the twelfth TFT T12 is turned on and the second Q node Q2 of the second circuit block BL2 of the second stage STG2 has a logic high state corresponding to the high level voltage Vdd. As a result, the twentieth TFT T20 of the second circuit block BL2 of the second stage STG2 is turned on and the second emission signal EM(2) has a logic high state corresponding to the high level voltage Vdd. That is, the second emission signal EM(2) is changed from a logic low state to a logic high state.

Next, when high levels of the emission reset voltage ERST and the second scan signal Scan(2) are inputted to the second circuit block BL2 of the second stage STG2, the fifteenth and sixteenth TFTs T15 and T16 of the second circuit block BL2 of the second stage STG2 are turned on and the second QB node QB2 of the second circuit block BL2 of the second stage STG2 has a logic high state corresponding to the high level voltage Vdd. As a result, the twenty-first and twenty-second TFTs T21 and T22 of the second circuit block BL2 of the second stage STG2 are turned on and the second emission signal EM(2) has a logic low state corresponding to the low level voltage Vss. That is, the second emission signal EM(2) is changed from a logic high stat to a logic low state.

Next, when a high level of the second emission clock ECLK2 is inputted to the second circuit block BL2 of the second stage STG2, the twelfth TFT T12 is turned on and the second Q node Q2 of the second circuit block BL2 of the second stage STG2 has a logic high state corresponding to the high level voltage Vdd. As a result, the twentieth TFT T20 of the second circuit block BL2 of the second stage STG2 is turned on and the second emission signal EM(2) has a logic high state corresponding to the high level voltage Vdd. That is, the second emission signal EM(2) is changed from a logic low state to a logic high state.

While the scan signal generated from the scan signal generating unit is supplied to the gate line and the emission signal generating unit controls the state of the QB node of the inverter using the signal generated from the shift register in the related art, the nth scan signal Scan(n) generated from the first circuit block BL1 is supplied to the sixteenth TFT T16 of the second circuit block BL2 in a first embodiment of the present invention. When the nth scan signal Scan(n) has a logic low state, the second QB node QB2 of the second circuit block BL2 may have an electrically floating potential. As a result, operation characteristics of the twenty-first and twenty-second TFTs T21 and T22 may be deteriorated and the nth emission signal EM(n) may be destabilized.

For the purpose of preventing the above deterioration, the second QB node QB2 may be held stable using the emission reset voltage ERST and the emission clocks ECLK1 to ECLK5. The kind and order of the emission clocks ECLK1 to ECLK5 may vary in another embodiment. For example, while the first emission signal EM(1) has a logic high state, the second Q node Q2 may have a logic high state due to the first emission clock ECLK1 and the twentieth TFT T20 may be turned on. As a result, the first emission signal EM(1) may be held to have a logic high state. In addition, while the first emission signal EM(1) has a logic low state, the second QB node QB2 may have a logic high state due to the emission reset signal ERST and the first scan signal Scan(1) and the twenty-first and twenty-second TFTs T21 and T22 may be turned on. As a result, the first emission signal EM(1) may be held to have a logic low state.

The third node N3 (of FIG. 4) of each pixel P (of FIG. 4) is initialized during an initialization time period TPinit where the nth scan signal Scan(n) has a logic high state and the nth emission signal EM(n) has a logic low state. Further, the threshold voltage of the driving TFT DTr (of FIG. 4) is stored in the first pixel capacitor C1 (of FIG. 4) during a sampling time period TPsamp where the nth scan signal Scan(n) has a logic high state and the nth emission signal EM(n) has a logic high state.

Figure 8:
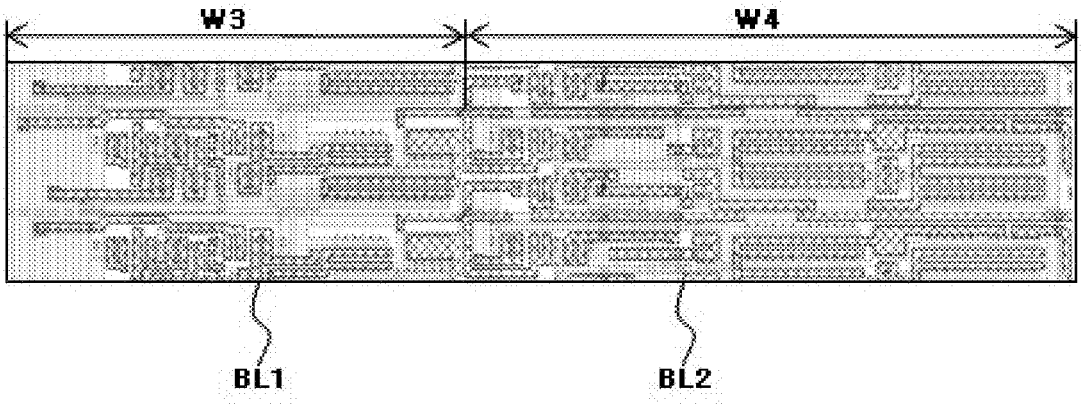
FIG. 8 is a plan view showing a gate driver of an organic light emitting diode display device according to a first embodiment of the present invention.

FIG. 8 is a plan view showing a gate driver of an organic light emitting diode display device according to a first embodiment of the present invention.

Figure 1:
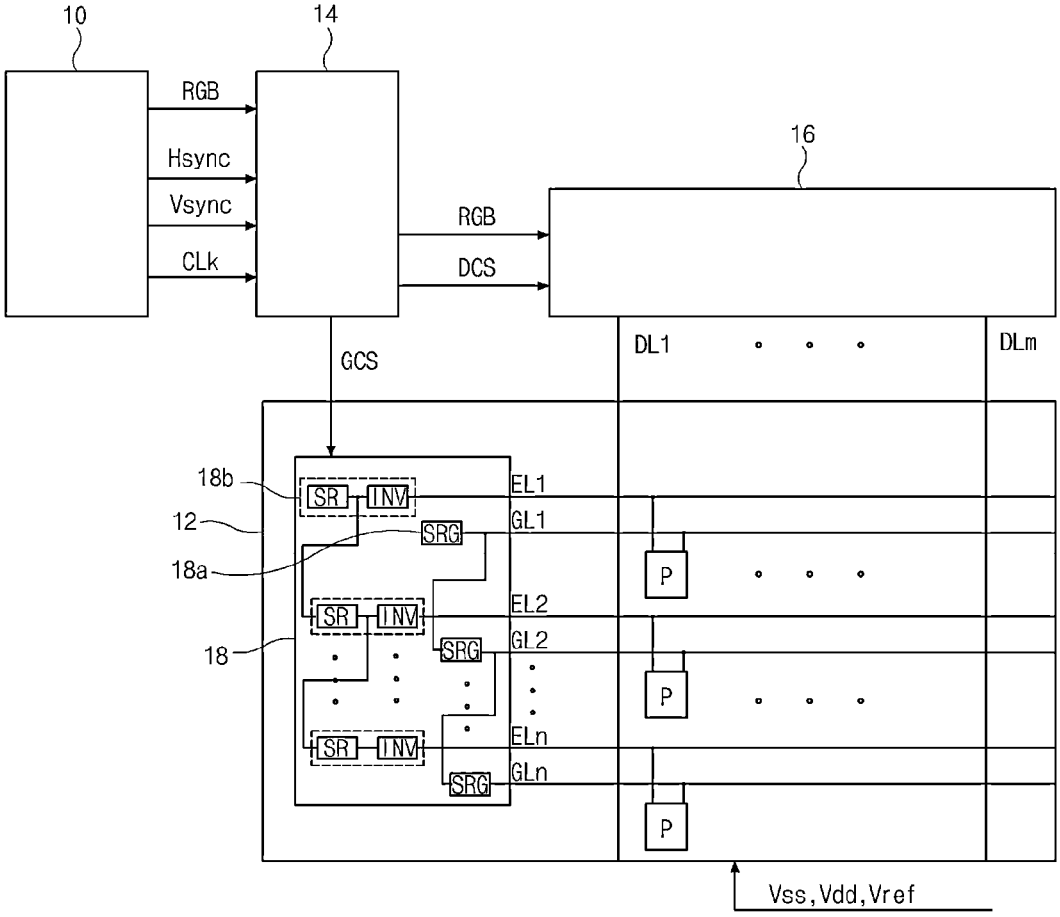
FIG. 1 (related art)
FIG. 1 is a view showing an organic light emitting diode display device according to the related art.
Figure 2:
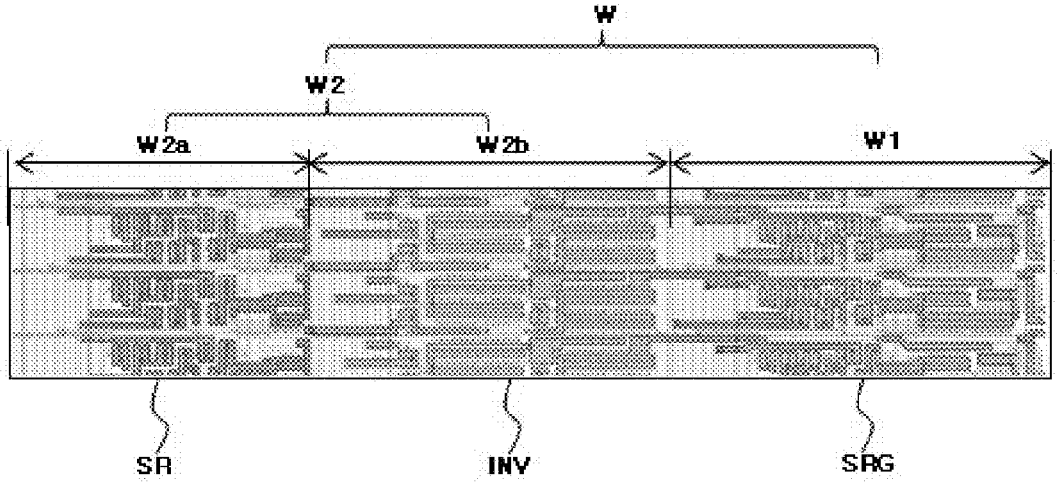
FIG. 2 (related art)
FIG. 2 is a plan view showing a gate driver of an organic light emitting diode display device according to the related art.

In FIG. 8, the gate driver 108 (of FIG. 3) of a GIP type is formed in a non-display area of the display panel 102 (of FIG. 3). For example, the first circuit block BL1 may be formed in a third area W3 and the second circuit block BL2 may be formed in a fourth area W4. Since elements for the gate driver 108 is reduced as compared with the related art, a sum of the third and fourth areas W3 and W4 is smaller than a sum of the first and second areas W1 and W2 (of FIG. 2). For example, the gate driver 108 including the first and second circuit blocks BL1 and BL2 may have a width of about 865 μm, while the gate driver including the scan signal generating unit and the emission signal generating unit of the related art may have a width of about 1100 μm. As a result, an area for the gate driver 108 is reduced by about 21.4% as compared with an area for the gate driver of the related art. In addition, since the elements for the gate driver 108 are reduced, conductive lines connected to the elements are reduced to obtain a narrow bezel.

Figure 9:
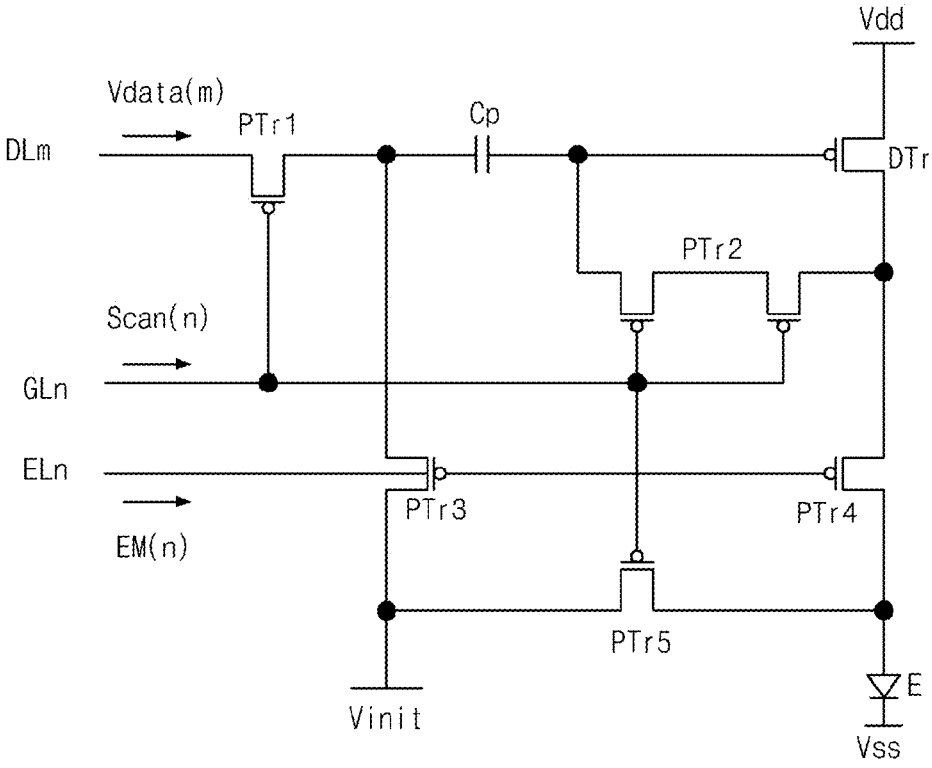
FIG. 9 is a view showing a pixel of an organic light emitting diode display device according to a second embodiment of the present invention.
Figure 10:
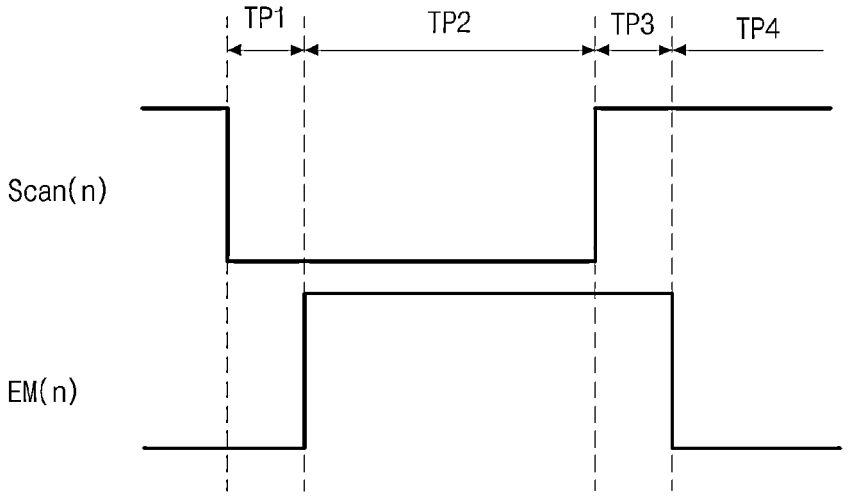
FIG. 10 is a timing chart showing signals for an organic light emitting diode display device according to a second embodiment of the present invention.

FIG. 9 is a view showing a pixel of an organic light emitting diode display device according to a second embodiment of the present invention, and FIG. 10 is a timing chart showing signals for an organic light emitting diode display device according to a second embodiment of the present invention.

Since the schematic structure of the gate driver and the organic light emitting diode display device according to the second embodiment is the same as that according to the first embodiment, illustration for the gate driver and the organic light emitting diode display device is omitted.

In FIG. 9, a pixel P includes a light emitting diode E, first to fifth pixel TFTs PTr1 to PTr5, a driving TFT DTr and a pixel capacitor Cp. The pixel P has a 6T1C structure where six transistors and one capacitor are formed in the pixel P. Although the first to fifth pixel TFTs PTr1 to PTr5 and the driving TFT DTr have a positive (P) type in FIG. 9, the first to fifth pixel TFTs PTr1 to PTr5 and the driving TFT DTr may have a negative (N) type in another embodiment.

The light emitting diode E emits a light by a driving current flowing between the high level voltage Vdd and the low level voltage Vss. For example, a cathode of the light emitting diode E may be connected to an input terminal of the low level voltage Vss and an anode of the light emitting diode E may be connected to a drain of the driving TFT DTr.

The first pixel transistor PTr1 transmits an mth data voltage Vdata(m) of an mth data line DLm to the pixel capacitor Cp according to an nth scan signal Scan(n). For example, a gate of the first pixel TFT PTr1 may be connected to an nth gate line GLn, a source of the first pixel TFT PTr1 may be connected to a first of the pixel capacitor Cp, and a drain of the first pixel TFT PTr1 may be connected to the mth data line DLm.

The second pixel TFT PTr2 transmits an initial voltage Vinit to a gate of the driving TFT DTr according to the nth scan signal Scan(n) of the nth gate line GLn. For example, a gate of the second pixel TFT PTr2 may be connected to the nth gate line GLn, a source of the second pixel TFT PTr2 may be connected to a drain of the driving TFT DTr and a source of the fourth pixel TFT PTr, and a drain of the second pixel TFT PTr2 may be connected to a gate of the driving TFT DTr and a second terminal of the pixel capacitor Cp. Although the second pixel TFT PTr2 has a dual gate type in the second embodiment, the second pixel TFT PTr2 may have a single gate type in another embodiment.

The third pixel TFT PTr3 transmits an initialization voltage Vinit to the first terminal of the pixel capacitor Cp according to an nth emission signal EM(n) of an nth emission line ELn. For example, a gate of the third pixel TFT PTr3 may be connected to the nth emission line ELn, a source of the third pixel TFT PTr3 may be connected to a source of the first pixel TFT PTr1 and the first terminal of the pixel capacitor Cp, and a drain of the third pixel TFT PTr3 may be connected to an input terminal of the initialization voltage Vinit and a drain of the fifth pixel TFT PTr5.

The fourth pixel TFT PTr4 transmits the initialization voltage Vinit to the second terminal of the pixel capacitor Cp and transmits the high level voltage Vdd to an anode of the light emitting diode E according to the nth emission signal EM(n) of an nth emission line ELn. For example, a gate of the fourth pixel TFT PTr4 may be connected to the nth emission line ELn, a source of the fourth pixel TFT PTr4 may be connected to a source of the second pixel TFT PTr2 and a drain of the driving TFT DTr, and a drain of the fourth pixel TFT PTr4 may be connected to a drain of the fifth pixel TFT PTr5 and the anode of the light emitting diode E.

The fifth pixel TFT PTr5 transmits the initialization voltage Vinit to a gate of the driving TFT DTr according to the nth scan signal Scan(n) of the nth gate line GLn. For example, a gate of the fifth pixel TFT PTr5 may be connected to the nth gate line GLn, a source of the fifth pixel TFT PTr5 may be connected to a drain of the fourth pixel TFT PTr4 and the anode of the light emitting diode E, and a drain of the fifth pixel TFT PTr5 may be connected to the input terminal of the initialization voltage Vinit and a drain of the third pixel TFT PTr3.

The driving TFT DTr transmits the high level voltage Vdd to the anode of the light emitting diode E according to a voltage of the second terminal of the pixel capacitor Cp. For example, a gate of the driving TFT DTr may be connected to the second terminal of the pixel capacitor Cp and a drain of the second pixel TFT PTr2, a source of the driving TFT DTr may be connected to the input terminal of the high level voltage Vdd, and a drain of the driving TFT DTr may be connected to a source of the second pixel TFT PTr2 and a source of the fourth pixel TFT PTr4.

The pixel capacitor Cp stores the mth data voltage Vdata (m) and a threshold voltage Vth of the driving TFT DTr. For example, the first terminal of the pixel capacitor Cp may be connected to a source of the first pixel TFT PTr1 and a source of the third pixel TFT PTr3, and the second terminal of the pixel capacitor Cp may be connected to a gate of the driving TFT DTr and a drain of the second pixel TFT PTr2.

The light emitting diode E emits a light according to a current flowing between the input terminal of the high level voltage Vdd and the input terminal of the low level voltage Vss. For example, the anode of the light emitting diode E may be connected to a drain of the driving TFT DTr and a source of the second pixel TFT PTr2, and the cathode of the light emitting diode E may be connected to the input terminal of the low level voltage Vss.

In FIG. 10, during a first time period TP1 for initialization, the first, second and fifth pixel TFTs PTr1, PTr2 and PTr5 are turned on by the nth scan signal Scan(n) having a low level, and the third and fourth pixel TFTs PTr3 and PTr4 are turned on by the nth emission signal EM(n) having a low level. As a result, the first and second terminals of the pixel capacitor Cp and the gate of the driving TFT DTr are charged by the initialization voltage Vinit.

During a second time period TP2 for sampling and writing, the first, second and fifth pixel TFTs PTr1, PTr2 and PTr5 are turned on by the nth scan signal Scan(n) having a low level, and the third and fourth pixel TFTs PTr3 and PTr4 are turned off by the nth emission signal EM(n) having a high level. As a result, the mth data voltage Vdata(m) and the threshold voltage Vth are stored in the pixel capacitor Cp.

During a third time period TP3 for holding, the first, second and fifth pixel TFTs PTr1, PTr2 and PTr5 are turned off by the nth scan signal Scan(n) having a high level, and the third and fourth pixel TFTs PTr3 and PTr4 are turned off by the nth emission signal EM(n) having a high level. As a result, a voltage of the gate of the driving TFT DTr is held as the mth data voltage Vdata(m) and the threshold voltage Vth.

During a fourth time period TP4 for emission, the first, second and fifth pixel TFTs PTr1, PTr2 and PTr5 are turned off by the nth scan signal Scan(n) having a high level, and the third and fourth pixel TFTs PTr3 and PTr4 are turned on by the nth emission signal EM(n) having a low level. As a result, a current corresponding to the mth data voltage Vdata(m) and the threshold voltage Vth flows the driving TFT DTr and the light emitting diode E emits a light.

Figure 11:
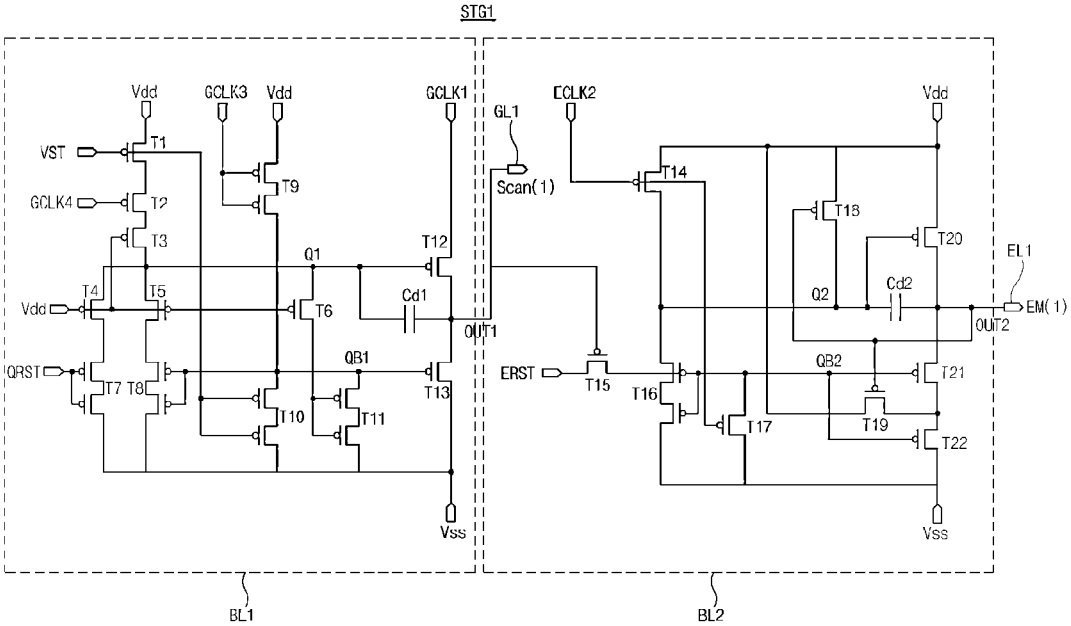
FIG. 11 is a view showing a first stage of a light emitting diode display device according to a second embodiment of the present invention.

FIG. 11 is a view showing a first stage of a light emitting diode display device according to a second embodiment of the present invention. Since the cascade connection among first to pth stages STG1 to STGp of the second embodiment is the same as the cascade connection among the first to pth stages of the first embodiment, illustration for the cascade connection is omitted.

In FIG. 11, a first stage STG1 of a gate driver includes first and second circuit blocks BL1 and BL2. The first circuit block BL1 of the first stage STG1 generates the first scan signal Scan(1) using the high level voltage Vdd, the low level voltage Vss, the start voltage VST, the first, third and fourth gate clocks GCLK1, GCLK3 and GCLK4 and a Q node reset voltage QRST. The second circuit block BL2 of the first stage STG1 generates the first emission signal EM(1) using the high level voltage Vdd, the low level voltage Vss, the first scan signal Scan(1) outputted from the first circuit block BL1, the second emission clocks ECLK2 and the emission reset voltage ERST.

As a result, the gate driver may include a single stage generating the scan signal and the emission signal in the second embodiment of the present invention, while the gate driver includes the scan signal generating unit generating the scan signal and the emission signal generating unit generating the emission signal in the related art.

The first circuit block BL1 of the first stage STG1 may include first to thirteenth TFTs T1 to T13 and a first driving capacitor Cd1. A gate of the first TFT T1 may be connected to an input terminal of the start voltage VST, a source of the first TFT T1 may be connected to an input terminal of the high level voltage Vdd and a drain of the first TFT T1 may be connected to a source of the second TFT T2. A gate of the second TFT T2 may be connected to an input terminal of the fourth gate clock GCLK4, a source of the second TFT T2 may be connected to the drain of the first TFT T1 and a drain of the second TFT T2 may be connected to a source of the third TFT T3. A gate of the third TFT T3 may be connected to an input terminal of the high level voltage Vdd, a source of the third TFT T3 may be connected to the drain of second TFT T2, and a drain of the third TFT T3 may be connected to a first Q node Q1.

A gate of the fourth TFT T4 may be connected to an input terminal of the high level voltage Vdd, a source of the fourth TFT T4 may be connected to the first Q node Q1, and a drain of the fourth TFT T4 may be connected to a source of the seventh TFT T7. A gate of the fifth TFT T5 may be connected to an input terminal of the high level voltage Vdd, a source of the fifth TFT T5 may be connected to the first Q node Q1, and a drain of the fifth TFT T5 may be connected to a source of the eighth TFT T8. A gate of the sixth TFT T6 may be connected to an input terminal of the high level voltage Vdd, a source of the sixth TFT T6 may be connected to a first QB node QB 1, a drain of the sixth TFT T6 may be connected to a gate of the tenth TFT T10.

A gate of the seventh TFT T7 may be connected to an input terminal of the Q node reset voltage QRST, a source of the seventh TFT T7 may be connected to a drain of the fourth TFT T4, and a drain of the seventh TFT T7 may be connected to an input terminal of the low level voltage Vss. A gate of the eighth TFT T8 may be connected to a first QB node QB1, a source of the eighth TFT T8 may be connected to a drain of the fifth TFT T5, and a drain of the eighth TFT T8 may be connected to an input terminal of the low level voltage Vss.

A gate of the ninth TFT T9 may be connected to an input terminal of the third gate clock GCLK3, a source of the ninth TFT T9 may be connected to an input terminal of the high level voltage Vdd, and a drain of the ninth TFT T9 may be connected to the first QB node QB1. A gate of the tenth TFT T10 may be connected to an input terminal of the start voltage VST, a source of the tenth TFT T10 may be connected to the first QB node QB1, and a drain of the tenth TFT T10 may be connected to an input terminal of the low level voltage Vss. A gate of the eleventh TFT T11 may be connected to a drain of the sixth TFT T6, a source of the eleventh TFT T11 may be connected to the first QB node QB1, and a drain of the eleventh TFT T11 may be connected to an input terminal of the low level voltage Vss. Although each of the seventh to eleventh TFTs T7 to T11 has a dual gate type for improving an off-current property in FIG. 11, each of the seventh to eleventh TFTs T7 to T11 may have a single gate type in another embodiment having a relatively small off-current.

A gate of the twelfth TFT T12 may be connected to the first Q node Q1, a source of the twelfth TFT T12 may be connected to an input terminal of the first gate clock GCLK1, and a drain of the twelfth TFT T12 may be connected to a source of the thirteenth TFT T13. The first driving capacitor Cd1 is connected between the gate and the drain of the twelfth TFT T12. A gate of the thirteenth TFT T13 may be connected to the first QB node QB1, a source of the thirteenth TFT T13 may be connected to a drain of the twelfth TFT T12, and a drain of the thirteenth TFT T13 may be connected to an input terminal of the low level voltage Vss.

A first output node OUT1 between the drain of the twelfth TFT T12 and the source of the thirteenth TFT T13 may be connected to the first gate line GL1, the second circuit block BL2 of the first stage STG1 and the first circuit block BL1 of the second stage STG2, and the first scan signal Scan(1) outputted from the first output node OUT1 may be supplied to the first gate line GL1, the second circuit block BL2 of the first stage STG1 and the first circuit block BL1 of the second stage STG2.

The second circuit block BL2 of the first stage STG1 may include fourteenth to twenty-second TFTs T14 to T22 and a second driving capacitor Cd2. A gate of the fourteenth TFT T14 may be connected to an input terminal of the second emission clock ECLK2, a source of the fourteenth TFT T14 may be connected to an input terminal of the high level voltage Vdd and a drain of the fourteenth TFT T14 may be connected to a second Q node Q2. A gate of the fifteenth TFT T15 may be connected to an input terminal of the first output node OUT1 of the first circuit block BL1, a source of the fifteenth TFT T15 may be connected to the second Q node Q2 and a drain of the fifteenth TFT T15 may be connected to a second QB node QB2. A gate of the sixteenth TFT T16 may be connected to the second QB node QB2, a source of the sixteenth TFT T16 may be connected to the second Q node Q2, and a drain of the sixteenth TFT T16 may be connected to an input terminal of the low level voltage Vss.

A gate of the seventeenth TFT T17 may be connected to an input terminal of the second emission clock ECLK2, a source of the seventeenth TFT T17 may be connected to the second QB node QB2, and a drain of the seventeenth TFT T17 may be connected to an input terminal of the low level voltage Vss. A gate of the eighteenth TFT T18 may be connected to a second output node OUT2, a source of the eighteenth TFT T18 may be connected to an input terminal of the high level voltage Vdd, and a drain of the eighteenth TFT T18 may be connected to a drain of the twenty-first TFT T21 and a source of the twenty-second TFT T22. A gate of the nineteenth TFT T19 may be connected to the second output node OUT2, a source of the nineteenth TFT T19 may be connected to an input terminal of the high level voltage Vdd, and a drain of the nineteenth TFT T19 may be connected to a drain of the twenty-first TFT T21 and a source of the twenty-second TFT T22.

A gate of the twentieth TFT T20 may be connected to the second Q node Q2, a source of the twentieth TFT T20 may be connected to an input terminal of the high level voltage Vdd, and a drain of the twentieth TFT T20 may be connected to a source of the twenty-first TFT T21. The second driving capacitor Cd2 is connected between the gate and the drain of the twentieth TFT T20. A gate of the twenty-first TFT T21 may be connected to the second QB node QB2, a source of the twenty-first TFT T21 may be connected to a drain of the twentieth TFT T20, and a drain of the twenty-first TFT T21 may be connected to a drain of the nineteenth TFT T19 and a source of the twenty-second TFT T22. A gate of the twenty-second TFT T22 may be connected to the second QB node QB2, a source of the twenty-second TFT T22 may be connected to a drain of the nineteenth TFT T19 and a drain of the twenty-first TFT T21, and a drain of the twenty-second TFT T22 may be connected to an input terminal of the low level voltage Vss.

The second output node OUT2 between the drain of the twentieth TFT T20 and the source of the twenty-first TFT T21 may be connected to the first emission line ELL and the first emission signal EM(1) outputted from the second output node OUT2 may be supplied to the first emission line EL1.

Although not shown, the first and second circuit blocks BL1 and BL2 of the second stage STG2 use the nth scan signal Scan(n) instead of the start voltage VST. The first circuit block BL1 of the second stage STG2 has a similar structure to the first circuit block BL1 of the first stage STG1, and the second circuit block BL2 of the second stage STG2 has a similar structure to the second circuit block BL2 of the first stage STG1. Illustration for the same structure is omitted.

In the first circuit block BL1 of the second stage STG2, a gate of the first TFT T1 may be connected to the first output node OUT1 of the first circuit block BL1 of the first stage STG1 instead of an input terminal of the start voltage VST. A gate of the second TFT T2 may be connected to an input terminal of the first gate clock GCLK1 instead of an input terminal of the fourth gate clock GCLK4.

In addition, the first output node OUT1 of the second stage STG2 may be connected to the second gate line GL2, the second circuit block BL2 of the second stage STG2 and the first circuit block BL1 of third stage STG3, and the second scan signal Scan(2) outputted from the first output node OUT1 of the second stage STG2 may be supplied to the second gate line GL2, the second circuit block BL2 of the second stage STG2 and the first circuit block BL1 of the third stage STG3.

In the second circuit block BL2 of the second stage STG2, a gate of each of the fourteenth and seventeenth TFTs T14 and T17 may be connected to an input terminal of the third emission clock ECLK3 instead of an input terminal of the second emission clock ECLK2. In addition, the second output node OUT2 may be connected to the second emission line EL2, and the second emission signal EM(2) outputted from the second output node OUT2 may be supplied to the second emission line EM2.

Although not shown, the other stages STG3 to STGp may have a structure similar to the second stage STG2, and the plurality of stages STG1 to STGp may be connected in cascade. For example, the nth stage STGn may output the nth scan signal Scan(n) and the nth emission signal EM(n) using the high level voltage Vdd, the low level voltage Vss, the (n−1)th scan signal Scan(n−1), the first, third and fourth gate clocks GCLK1, GCLK3 and GCLK4, the Q node reset voltage QRST, the second emission clock ECLK2 and the emission reset voltage ERST. The nth scan signal Scan(n) and the nth emission signal EM(n) may be supplied to the nth gate line GLn and the nth emission line ELn, respectively, corresponding to an nth horizontal pixel line HPLn. In addition, the (n+1)th stage STG(n+1) may output the (n+1)th scan signal Scan(n+1) and the (n+1)th emission signal EM(n+1) using the high level voltage Vdd, the low level voltage Vss, the nth scan signal Scan(n), the first, second and fourth gate clocks GCLK1, GCLK2 and GCLK4, the Q node reset voltage QRST, the third emission clock ECLK3 and the emission reset voltage ERST. The (n+1)th scan signal Scan(n+1) and the (n+1)th emission signal EM(n+1) may be supplied to the (n+1)th gate line GL(n+1) and the (n+1)th emission line EL(n+1), respectively, corresponding to an (n+1)th horizontal pixel line HPL(n+1).

Although the first to twenty-second TFTs T1 to T22 have a positive (P) type in FIG. 9, at least one of the first to twenty-second TFTs T1 to T22 may have a negative (N) type in another embodiment.

Operation of the gate driver of the OLED device according to a second embodiment of the present invention will be illustrated hereinafter.

Figure 12:
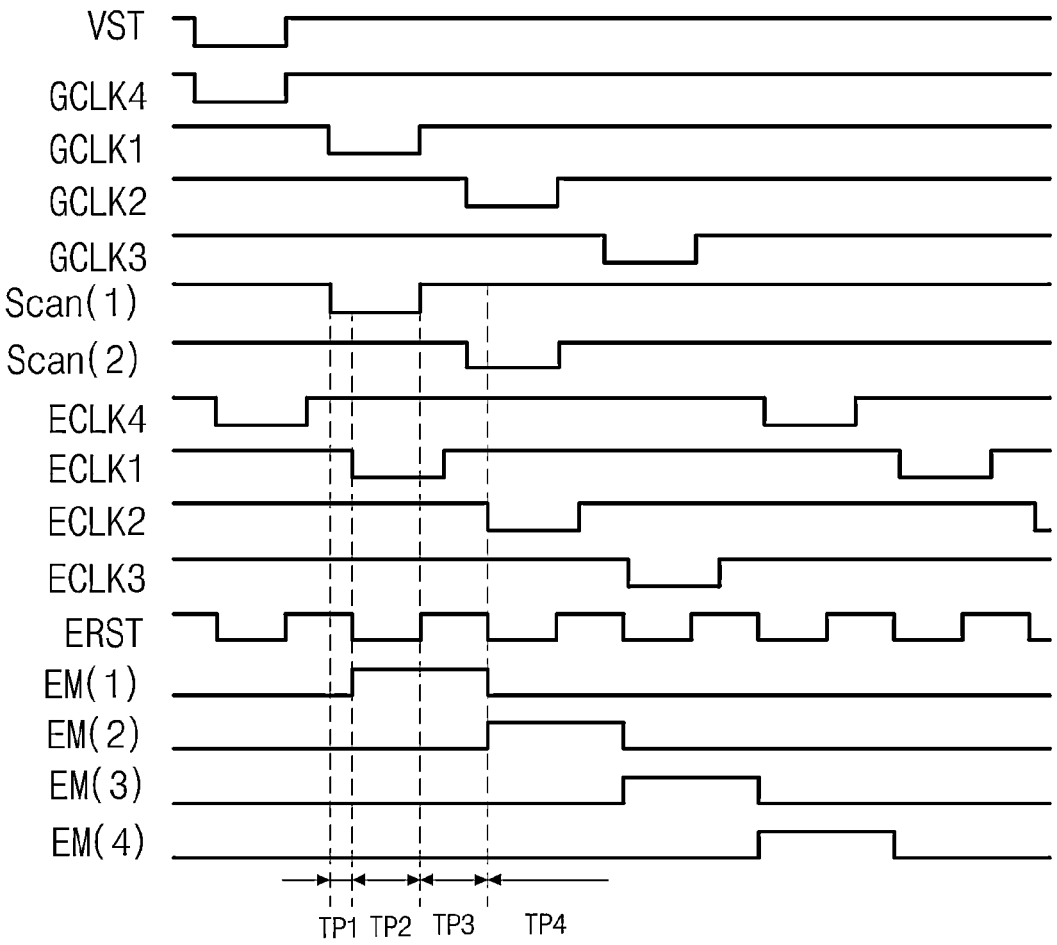
FIG. 12 is a timing chart showing signals used in a light emitting diode display device according to a second embodiment of the present invention.

FIG. 12 is a timing chart showing signals used in a light emitting diode display device according to a second embodiment of the present invention.

In FIGS. 11 and 12, when low levels of the start voltage VST and the fourth gate clock GCLK4 are inputted to the first circuit block BL1 of the first stage STG1, the first and second TFTs T1 and T2 of the first circuit block BL1 of the first stage STG1 are turned on and the first Q node Q1 of the first circuit block BL1 of the first stage STG1 has a logic high state corresponding to the high level voltage Vdd. As a result, the twelfth TFT T12 whose gate is connected to the first Q node Q1 of the first circuit block BL1 of the first stage STG1 has a ready state. Next, when a low level of the first gate clock GCLK1 is inputted to the first circuit block BL1 of the first stage STG1, the twelfth TFT T12 of the first circuit block BL1 of the first stage STG1 is turned on and the first scan signal Scan(1) is outputted from the first output node OUT1 of the first circuit block BL1 of the first stage STG1. The first scan signal Scan(1) outputted from the first output node OUT1 of the first circuit block BL1 of the first stage STG1 may be inputted to the first gate line GL1, the fifteenth TFT T15 of the second circuit block BL2 of the first stage STG1 and the first circuit block BL1 of the second stage STG2.

Although not shown, when the first gate clock GCLK1 is inputted to the first circuit block BL1 of the second stage STG2, the first and second TFTs T1 and T2 of the first circuit block BL1 of the second stage STG2 are turned on and the first Q node Q1 of the first circuit block BL1 of the second stage STG2 has a logic high state corresponding to the high level voltage Vdd. As a result, the twelfth TFT T12 whose gate is connected to the first Q node Q1 of the first circuit block BL1 of the second stage STG2 has a ready state. Next, when a low level of the second gate clock GCLK2 is inputted to the first circuit block BL1 of the second stage STG2, the twelfth TFT T12 of the first circuit block BL1 of the second stage STG2 is turned on and the second scan signal Scan(2) is outputted from the first output node OUT1 of the first circuit block BL1 of the second stage STG2. The second scan signal Scan(2) outputted from the first output node OUT1 of the first circuit block BL1 of the second stage STG2 may be inputted to the second gate line GL2, the fifteenth TFT T15 of the second circuit block BL2 of the second stage STG2 and the first circuit block BL1 of the third stage STG3.

The first circuit block BL1 of the second stage STG2 generates the second scan signal Scan(2) using the first scan signal Scan(1) outputted from the first circuit block BL1 of the first stage STG1 instead of the start voltage VST. As a result, the first circuit blocks (odd circuit blocks) of the plurality of stages STG1 to STGp are connected in cascade such that the first circuit block of the present stage generates the present scan signal using the previous scan signal outputted from the first circuit block of the previous stage.

In addition, when low levels of the first scan signal Scan(1) and a high level of the emission reset voltage ERST are inputted to the second circuit block BL2 of the first stage STG1, the fourteenth TFT T14 of the second circuit block BL2 of the first stage STG1 is turned on and the second QB node QB2 of the second circuit block BL2 of the first stage STG1 has a logic high state. As a result, the twenty-first and twenty-second TFTs T21 and T22 of the second circuit block BL2 of the first stage STG1 are turned off and the first emission signal EM(1) is held to have a previous logic low state.

Next, when a low level of the first scan signal Scan(1) and a low level of the emission reset voltage ERST are inputted to the second circuit block BL2 of the first stage STG1, the sixteenth TFT T16 of the second circuit block BL2 of the first stage STG1 is turned on and the second Q node Q2 of the second circuit block BL2 of the first stage STG1 is changed from a logic high state to a logic low sate corresponding to the low level voltage Vss. As a result, the twentieth TFT T20 of the second circuit block BL2 of the first stage STG1 is turned on and the first emission signal EM(1) has a logic high state corresponding to the high level voltage Vdd. That is, the first emission signal EM(1) is changed from a logic low state to a logic high state.

Next, when a high level of the first scan signal Scan(1) is inputted to the second circuit block BL2 of the first stage STG1, the fifteenth TFT T15 is turned off and the first emission signal EM(1) is held to have a previous logic high state.

Next, when a low level of the second emission clock ECLK2 is inputted to the second circuit block BL2 of the first stage STG1, the seventeenth TFT T17 of the second circuit block BL2 of the first stage STG1 is turned on and the second QB node QB2 of the second circuit block BL2 of the first stage STG1 has a logic low state corresponding to the low level voltage Vss. As a result, the twenty-first and twenty-second TFTs T21 and T22 of the second circuit block BL2 of the first stage STG1 are turned on and the first emission signal EM(1) has a logic low state corresponding to the low level voltage Vss. That is, the first emission signal EM(1) is changed from a logic high stat to a logic low state.

Although not shown, when a low level of the second scan signal Scan(2) and a high level of the emission reset voltage ERST are inputted to the second circuit block BL2 of the second stage STG2, the fourteenth TFT T14 of the second circuit block BL2 of the second stage STG2 is turned on and the second QB node QB2 of the second circuit block BL2 of the second stage STG2 has a logic high state. As a result, the twenty-first and twenty-second TFTs T21 and T22 of the second circuit block BL2 of the second stage STG2 are turned off and the second emission signal EM(2) is held to have a previous logic low state.

Next, when a low level of the second scan signal Scan(2) and a low level of the emission reset voltage ERST are inputted to the second circuit block BL2 of the second stage STG2, the sixteenth TFT T16 of the second circuit block BL2 of the second stage STG2 is turned on and the second Q node Q2 of the second circuit block BL2 of the second stage STG2 is changed from a logic high state to a logic low sate corresponding to the low level voltage Vss. As a result, the twentieth TFT T20 of the second circuit block BL2 of the second stage STG2 is turned on and the second emission signal EM(2) has a logic high state corresponding to the high level voltage Vdd. That is, the second emission signal EM(2) is changed from a logic low state to a logic high state.

Next, when a high level of the second scan signal Scan(2) is inputted to the second circuit block BL2 of the second stage STG2, the fifteenth TFT T15 is turned off and the second emission signal EM(2) is held to have a previous logic high state.

Next, when a low level of the third emission clock ECLK3 is inputted to the second circuit block BL2 of the second stage STG2, the seventeenth TFT T17 of the second circuit block BL2 of the second stage STG2 is turned on and the second QB node QB2 of the second circuit block BL2 of the second stage STG2 has a logic low state corresponding to the low level voltage Vss. As a result, the twenty-first and twenty-second TFTs T21 and T22 of the second circuit block BL2 of the second stage STG2 are turned on and the second emission signal EM(2) has a logic low state corresponding to the low level voltage Vss. That is, the second emission signal EM(2) is changed from a logic high stat to a logic low state.

While the scan signal generated from the scan signal generating unit is supplied to the gate line and the emission signal generating unit controls the state of the QB node of the inverter using the signal generated from the shift register in the related art, the nth scan signal Scan(n) generated from the first circuit block BL1 is supplied to the fifteenth TFT T15 of the second circuit block BL2 in the second embodiment of the present invention. When the nth scan signal Scan(n) has a logic low state, the second QB node QB2 of the second circuit block BL2 may have an electrically floating potential. As a result, operation characteristics of the twenty-first and twenty-second TFTs T21 and T22 may be deteriorated and the nth emission signal EM(n) may be destabilized.

For the purpose of preventing the above deterioration, the second QB node QB2 may be held stable using the emission clocks ECLK1 to ECLK4 and the seventeenth TFT T17. The kind and order of the emission clocks ECLK1 to ECLK4 may vary in another embodiment. For example, while the first emission signal EM(1) has a logic low state, the second QB node QB2 may have a logic low state due to the second emission clock ECLK2 and the twenty-first and twenty-second TFTs T21 and T22 may be turned on. As a result, the first emission signal EM(1) may be held to have a logic low state. In addition, while the first emission signal EM(1) has a logic high state, the second Q node Q2 may have a logic low state due to the emission reset signal ERST and the first scan signal Scan(1) and the twentieth TFT T20 may be turned on. As a result, the first emission signal EM(1) may be held to have a logic high state.

During the first time period TP1 where the nth scan signal Scan(n) has a low level and the nth emission signal has a low level, the gate of the driving TFT DTr (of FIG. 9) in each pixel P (of FIG. 9) is initialized. During the second time period TP2 where the nth scan signal Scan(n) has a low level and the nth emission signal has a high level, the mth data voltage Vdata(m) and the threshold voltage Vth are stored in the pixel capacitor Cp (of FIG. 9). During the third time period TP3 where the nth scan signal Scan(n) has a high level and the nth emission signal has a high level, the gate of the driving TFT DTr is held to have the mth data voltage Vdata(m) and the threshold voltage Vth. During the fourth time period TP4 where the nth scan signal Scan(n) has a high level and the nth emission signal has a low level, the light emitting diode E (of FIG. 9) emits a light.

Although not shown, the gate driver according to the second embodiment may be formed in a non-display area of the display panel. For example, the first circuit block BL1 may be formed in a third area and the second circuit block BL2 may be formed in a fourth area. Since elements for the gate driver is reduced as compared with the related art, a sum of the third and fourth areas W3 and W4 is smaller than a sum of the first and second areas W1 and W2 (of FIG. 2). For example, the gate driver including the first and second circuit blocks BL1 and BL2 of the second embodiment may have a width of about 841 μm, while the gate driver including the scan signal generating unit and the emission signal generating unit of the related art may have a width of about 1150 μm. As a result, an area for the gate driver is reduced by about 26.9% as compared with an area for the gate driver of the related art. In addition, since the elements for the gate driver are reduced, conductive lines connected to the elements are reduced to obtain a narrow bezel.

Consequently, in an OLED display device according to an embodiment of the present invention, since a scan signal and an emission signal are generated by a single stage of a gate driver, an area for the gate driver is reduced. In addition, since the conductive lines for supplying signals to the stage are reduced, a narrow bezel is obtained and appearance of the OLED display device is improved.

It will be apparent to those skilled in the art that various modifications and variations can be made in an OLED display device of the present disclosure without departing from the sprit or scope of the invention. Thus, it is intended that the present invention covers the modifications and variations of this invention provided they come within the scope of the appended claims and their equivalents.

What is claimed is:

1. An organic light emitting diode display device, comprising:

a display panel including a plurality of pixels;

a data driver supplying a data signal to the plurality of pixels;

a gate driver supplying a plurality of scan signals and a plurality of emission signals to the plurality of pixels, the gate driver including a plurality of stages, at least one of the plurality of stages having a first circuit block generating one of the plurality of scan signals and a second circuit block generating one of the plurality of emission signals using one of the plurality of scan signals; and a timing controller supplying a plurality of control signals to the data driver and the gate driver, wherein the first circuit block of an nth stage generates an nth scan signal using an (n−1)th scan signal, a plurality of gate clocks, a high level voltage and a low level voltage, and wherein the second circuit block of the nth stage generates an nth emission signal using the nth scan signal, a plurality of emission clocks, an emission reset voltage, the high level voltage and the low level voltage, wherein the plurality of gate clocks include first to fifth gate clocks of 5-phase pulse, and the plurality of emission clocks include first to fifth emission clocks of 5-phase pulse, and wherein the first circuit block includes first to eleventh thin film transistors (TFTs) and a first capacitor, and wherein the second circuit block includes twelfth to twenty-second TFTs and a second capacitor.

2. The device according to claim 1, wherein the first circuit block of a first stage generates a first scan signal using a start voltage, the plurality of gate clocks, the high level voltage and the low level voltage, and wherein the second circuit block of the first stage generates a first emission signal using the start voltage, the first scan signal, the plurality of emission clocks, the emission reset voltage, the high level voltage and the low level voltage.

3. The device according to claim 1, wherein the first to twenty-second TFTs have a negative type.

4. The device according to claim 1, wherein a gate of the first TFT is connected to one of an input terminal of a start voltage and the first circuit block of a previous stage, a source of the first TFT is connected to a drain of the second TFT, and a drain of the first TFT is connected to an input terminal of the high level voltage, wherein a gate of the second TFT is connected to one of input terminals of the plurality of gate clocks, a drain of the second TFT is connected to the source of the first TFT, and a source of the second TFT is connected to a drain of the third TFT, wherein a gate of the third TFT is connected to an input terminal of the high level voltage, a drain of the third TFT is connected to the source of second TFT, and a source of the third TFT is connected to a first Q node, wherein a gate of the fourth TFT is connected to an input terminal of the high level voltage, a drain of the fourth TFT is connected to the first Q node, and a source of the fourth TFT is connected to a drain of the sixth TFT, wherein a gate of the fifth TFT is connected to an input terminal of the high level voltage, a drain of the fifth TFT is connected to the first Q, and a source of the fifth TFT is connected to a gate of the eleventh TFT, wherein a gate of the sixth TFT is connected to a first QB node, a drain of the sixth TFT is connected to a source of the fourth TFT, and a source of the sixth TFT is connected to an input terminal of the low level voltage, wherein a gate of the seventh TFT may be connected to one of input terminals of the plurality of gate clocks, a drain of the seventh TFT is connected to an input terminal of the high level voltage, and a source of the seventh TFT is connected to the first QB, wherein a gate of the eighth TFT is connected to one of an input terminal of the start voltage and the first circuit block of the previous stage, a drain of the eighth TFT is connected to the first QB node, and a source of the eighth TFT is connected to an input terminal of the low level voltage, wherein a gate of the ninth TFT is connected to a source of the fifth TFT, a drain of the ninth TFT is connected to the first QB, and a source of the ninth TFT is connected to an input terminal of the low level voltage, wherein a gate of the tenth TFT is connected to the first Q node, a drain of the tenth TFT is connected to one of input terminals of the plurality of gate clocks, and a source of the tenth TFT is connected to a drain of the eleventh TFT, wherein a gate of the eleventh TFT is connected to the first QB node, a drain of the eleventh TFT is connected to a source of the tenth TFT, and a source of the eleventh TFT is connected to an input terminal of the low level voltage, wherein the first capacitor is connected between the gate and the source of the tenth TFT, and wherein a first output node between the source of the tenth TFT and the drain of the eleventh TFT is connected to a gate line of the display panel, the second circuit block and a next stage.

5. The device according to claim 1, wherein a gate of the twelfth TFT is connected to one of input terminals of the plurality of emission clocks, a drain of the twelfth TFT is connected to an input terminal of the high level voltage, and a source of the twelfth TFT is connected to a second Q node, wherein a gate of the thirteenth TFT is connected to one of input terminals of the plurality of emission clocks, a drain of the thirteenth TFT is connected to one of an input terminal of the start voltage and the first circuit block of a previous stage, and a source of the thirteenth TFT is connected to a second QB node, wherein a gate of the fourteenth TFT is connected to the second QB node, a drain of the fourteenth TFT is connected to the second Q node, and a source of the fourteenth TFT is connected to an input terminal of the low level voltage, wherein a gate of the fifteenth TFT is connected to an input terminal of the emission reset voltage, a drain of the fifteenth TFT is connected to an input terminal of the high level voltage, and a source of the fifteenth TFT is connected to a drain of the sixteenth TFT, wherein a gate of the sixteenth TFT is connected to a first output node of the first circuit block, a drain of the sixteenth TFT is connected to a source of the fifteenth TFT, and a source of the sixteenth TFT is connected to the second QB node, wherein a gate of the seventeenth TFT is connected to one of input terminals of the plurality of emission clocks, a drain of the seventeenth TFT is connected to the second QB node, and a source of the seventeenth TFT is connected to an input terminal of the low level voltage, wherein a gate of the eighteenth TFT is connected to a second output node, a drain of the eighteenth TFT is connected to an input terminal of the high level voltage, and a source of the eighteenth TFT is connected to a source of the twenty-first TFT, wherein a gate of the nineteenth TFT is connected to one of input terminals of the plurality of emission clocks, a drain of the nineteenth TFT is connected to the second QB node, and a source of the nineteenth TFT is connected to an input terminal of the low level voltage, wherein a gate of the twentieth TFT is connected to the second Q node, a drain of the twentieth TFT is connected to an input terminal of the high level voltage, and a source of the twentieth TFT is connected to a drain of the twenty-first TFT, wherein a gate of the twenty-first TFT is connected to the second QB node, a drain of the twenty-first TFT is connected to a source of the twentieth TFT, and a source of the twenty-first TFT is connected to a drain of the twenty-second TFT, wherein a gate of the twenty-second TFT is connected to the second QB node, a drain of the twenty-second TFT is connected to a source of the twenty-first TFT, and a source of the twenty-second TFT is connected to an input terminal of the low level voltage, wherein the second capacitor is connected between the gate and the source of the twentieth TFT, and wherein the second output node between the source of the twentieth TFT and the drain of the twenty-first TFT is connected to an emission line of the display panel.

6. The device according to claim 1, wherein each of the plurality of pixels includes a light emitting diode, an emission TFT, a switching TFT, a driving TFT, an initialization TFT and first and second pixel capacitors.

7. The device according to claim 6, wherein the emission TFT, the switching TFT, the driving TFT and the initialization TFT have a negative type.

8. An organic light emitting diode display device, comprising:

a display panel including a plurality of pixels;

a data driver supplying a data signal to the plurality of pixels;

a gate driver supplying a plurality of scan signals and a plurality of emission signals to the plurality of pixels, the gate driver including a plurality of stages, at least one of the plurality of stages having a first circuit block generating one of the plurality of scan signals and a second circuit block generating one of the plurality of emission signals using one of the plurality of scan signals; and a timing controller supplying a plurality of control signals to the data driver and the gate driver, wherein the first circuit block of a first stage generates a first scan signal using a start voltage, the plurality of gate clocks, a Q node reset voltage, the high level voltage and the low level voltage, and wherein the second circuit block of the first stage generates a first emission signal using the start voltage, the first scan signal, the plurality of emission clocks, the emission reset voltage, the high level voltage and the low level voltage, wherein the plurality of gate clocks include first to fourth gate clocks of 4-phase pulse, and the plurality of emission clocks include first to fourth emission clocks of 4-phase pulse, and wherein the first circuit block includes first to thirteenth thin film transistors (TFTs) and a first capacitor, and wherein the second circuit block includes fourteenth to twenty-second TFTs and a second capacitor.

9. The device according to claim 8, wherein the first to twenty-second TFTs have a positive type.

10. The device according to claim 8, wherein a gate of the first TFT is connected to an input terminal of a start voltage, a source of the first TFT is connected to an input terminal of the high level voltage and a drain of the first TFT is connected to a source of the second TFT, wherein a gate of the second TFT is connected to one of input terminals of the plurality of gate clocks, a source of the second TFT is connected to the drain of the first TFT and a drain of the second TFT is connected to a source of the third TFT, wherein a gate of the third TFT is connected to an input terminal of the high level voltage, a source of the third TFT is connected to the drain of second TFT, and a drain of the third TFT is connected to a first Q node, wherein a gate of the fourth TFT is connected to an input terminal of the high level voltage, a source of the fourth TFT is connected to the first Q node, and a drain of the fourth TFT is connected to a source of the seventh TFT, wherein a gate of the fifth TFT is connected to an input terminal of the high level voltage, a source of the fifth TFT is connected to the first Q node, and a drain of the fifth TFT is connected to a source of the eighth TFT, wherein a gate of the sixth TFT is connected to an input terminal of the high level voltage, a source of the sixth TFT is connected to a first QB node, a drain of the sixth TFT is connected to a gate of the tenth TFT, wherein a gate of the seventh TFT is connected to an input terminal of the Q node reset voltage, a source of the seventh TFT is connected to a drain of the fourth TFT, and a drain of the seventh TFT is connected to an input terminal of the low level voltage Vss, wherein a gate of the eighth TFT is connected to the first QB node, a source of the eighth TFT is connected to a drain of the fifth TFT, and a drain of the eighth TFT is connected to an input terminal of the low level voltage, wherein a gate of the ninth TFT is connected to one of the input terminals of the plurality of gate clocks, a source of the ninth TFT is connected to an input terminal of the high level voltage, and a drain of the ninth TFT is connected to the first QB node, wherein a gate of the tenth TFT is connected to an input terminal of the start voltage VST, a source of the tenth TFT is connected to the first QB node, and a drain of the tenth TFT is connected to an input terminal of the low level voltage, wherein a gate of the eleventh TFT is connected to a drain of the sixth TFT, a source of the eleventh TFT is connected to the first QB node, and a drain of the eleventh TFT is connected to an input terminal of the low level voltage, wherein a gate of the twelfth TFT is connected to the first Q node, a source of the twelfth TFT is connected to one of the input terminals of the plurality of gate clocks, and a drain of the twelfth TFT is connected to a source of the thirteenth TFT, wherein a gate of the thirteenth TFT is connected to the first QB node, a source of the thirteenth TFT is connected to a drain of the twelfth TFT, and a drain of the thirteenth TFT is connected to an input terminal of the low level voltage, wherein the first capacitor is connected between the gate and the drain of the twelfth TFT, and wherein a first output node between the drain of the twelfth TFT and the source of the thirteenth TFT is connected to a gate line of the display panel, the second circuit block and a next stage.

11. The device according to claim 8, wherein a gate of the fourteenth TFT is connected to one of input terminals of the plurality of emission clocks, a source of the fourteenth TFT is connected to an input terminal of the high level voltage and a drain of the fourteenth TFT is connected to a second Q node, wherein a gate of the fifteenth TFT is connected to an input terminal of a first output node of the first circuit block, a source of the fifteenth TFT is connected to the second Q node and a drain of the fifteenth TFT is connected to a second QB node, wherein a gate of the sixteenth TFT is connected to the second QB node, a source of the sixteenth TFT is connected to the second Q node, and a drain of the sixteenth TFT is connected to an input terminal of the low level voltage, wherein a gate of the seventeenth TFT is connected to one of the input terminals of the plurality of emission clocks, a source of the seventeenth TFT is connected to the second QB node, and a drain of the seventeenth TFT is connected to an input terminal of the low level voltage, wherein a gate of the eighteenth TFT is connected to a drain of the twentieth TFT, a source of the eighteenth TFT is connected to an input terminal of the high level voltage, and a drain of the eighteenth TFT is connected to a drain of the twenty-first TFT, wherein a gate of the nineteenth TFT is connected to a drain of the twentieth TFT, a source of the nineteenth TFT is connected to an input terminal of the high level voltage, and a drain of the nineteenth TFT is connected to a drain of the twenty-first TFT, wherein a gate of the twentieth TFT is connected to the second Q node, a source of the twentieth TFT is connected to an input terminal of the high level voltage, and a drain of the twentieth TFT is connected to a source of the twenty-first TFT, wherein a gate of the twenty-first TFT is connected to the second QB node, a source of the twenty-first TFT is connected to a drain of the twentieth TFT, and a drain of the twenty-first TFT is connected to a drain of the nineteenth TFT, wherein a gate of the twenty-second TFT is connected to the second QB node, a source of the twenty-second TFT is connected to a drain of the nineteenth TFT, and a drain of the twenty-second TFT is connected to an input terminal of the low level voltage, wherein the second capacitor is connected between the gate and the drain of the twentieth TFT, and wherein a second output node between the drain of the twentieth TFT and the source of the twenty-first TFT is connected to an emission line of the display panel.

12. The device according to claim 8, wherein each of the plurality of pixels includes a light emitting diode, first to fifth pixel TFTs, a driving TFT and a pixel capacitor.

13. The device according to claim 12, wherein the first to fifth pixel TFTs and the driving TFT have a positive type.

* * * * *